US007524234B2

(12) United States Patent
Hisata

(10) Patent No.: US 7,524,234 B2
(45) Date of Patent: Apr. 28, 2009

(54) LIQUID HONING MACHINE AND LIQUID HONING METHOD

(75) Inventor: Nobuhiko Hisata, Oyama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 11/970,754

(22) Filed: Jan. 8, 2008

(65) Prior Publication Data

US 2008/0119114 A1 May 22, 2008

Related U.S. Application Data

(62) Division of application No. 11/245,362, filed on Oct. 7, 2005, now Pat. No. 7,393,265.

(60) Provisional application No. 60/625,983, filed on Nov. 9, 2004.

(30) Foreign Application Priority Data

Oct. 8, 2004 (JP) ..... 2004-296757
Nov. 2, 2004 (JP) ..... 2004-319299

(51) Int. Cl.
*B24C 3/12* (2006.01)

(52) U.S. Cl. ..... 451/40; 134/7

(58) Field of Classification Search ..... 451/37, 451/38, 39, 40, 66, 73, 75, 82, 89; 134/7
See application file for complete search history.

(56) References Cited

U.S. PATENT DOCUMENTS 5,425,793 A * 6/1995 Mori et al. ..... 55/385.2
5,679,059 A * 10/1997 Nishi et al. ..... 451/41
5,779,520 A * 7/1998 Hayakawa ..... 451/41

FOREIGN PATENT DOCUMENTS

| | | |
|---|---|---|
| JP | 63-76462 | 5/1988 |
| JP | 6-27687 | 2/1994 |
| JP | 8-323627 | 12/1996 |
| JP | 9-236937 | 9/1997 |
| JP | 2001-296679 | 10/2001 |
| JP | 2002-351097 | 12/2002 |
| JP | 2004-246124 | 9/2004 |
| JP | 2005-140946 | 6/2005 |

* cited by examiner

*Primary Examiner*—Robert Rose
(74) *Attorney, Agent, or Firm*—Oblon, Spivak, McClelland, Maier & Neustadt, P.C.

(57) ABSTRACT

A honing machine 1 is provided with a honing zone 5 for subjecting a work 2 to a liquid honing process and a washing zone 6 for subjecting the work 2 to which the liquid honing process was executed at the honing zone 5 to a washing process in a housing 4 shielded from an external air, the honing zone 5 and the washing zone 6 being disposed adjacently. A partition wall 7 for preventing an ambient gas of the honing zone 5 from entering into the washing zone 6 is disposed between the honing zone 5 and the washing zone 6 in the housing 4. An in-liquid conveying apparatus 10 for conveying the work 2 to which the liquid honing process was executed at the honing zone 5 from the honing zone 5 to the washing zone 6 with the work kept immersed in the liquid 72 in a carrying bath 11 is disposed in the housing 4.

29 Claims, 12 Drawing Sheets

LIQUID HONING MACHINE AND LIQUID HONING METHOD

CROSS REFERENCE TO RELATED APPLICATIONS

This application is a divisional of U.S. Ser. No. 11/245,362, filed Oct. 7, 2005, which claims the benefit of priority from U.S. Provisional Application No. 60/625,983, filed Nov. 9, 2004, and further claims priority from Japanese Patent Application No. 2004-319299, filed Nov. 2, 2004, and Japanese Patent Application No. 2004-296757, filed Oct. 8, 2004. The entire disclosures of the aforementioned applications are incorporated herein by reference in their entirety.

FIELD OF THE INVENTION

The present invention relates to a liquid honing machine and a liquid honing method for subjecting various works such as raw pipes for precision pipes or raw pipes for photoconductor drum substrate pipes to a liquid honing process.

BACKGROUND ART

A photoconductor drum substrate for use in a photoconductor drum to be mounted in an electronic copying machine or a laser printer for supporting a photoconductive photosensitive layer of selenium or organic photoreceptor is formed of a metal pipe such as an aluminum (including its alloy) pipe. This pipe is required to have not only high dimensional precision (e.g., straightness) but also high surface precision to obtain a high quality image.

In the meantime, in many cases, although such pipe is manufactured of a raw pipe by a drawing process, the raw pipe of such pipe is often in an even surface status. Accordingly, the surface of the raw pipe has been subjected to a honing process to uniformize (e.g., roughen evenly) the surface of the raw pipe. Furthermore, since foreign substances such as abrasive grains or dirt adhering to the surface of the raw pipe, the raw pipe has been subjected to a washing process to remove the foreign substances (see Patent Documents 1 and 2).

Patent Document 1: JP 2001-296679, A

Patent Document 2: JP 2004-246124, A

DISCLOSURE OF THE INVENTION

Thus, it is considered to provide a liquid honing machine for subjecting a raw pipe to a liquid honing process and a washing process sequentially, wherein the liquid honing machine is provided with a honing zone for subjecting the raw pipe to a liquid honing process and a washing zone for subjecting the honed raw pipe to a washing process disposed adjacently in a housing isolated from ambient air. However, such liquid honing machine has the following drawbacks.

That is, in such liquid honing machine, abrasive grains contained in the honing liquid to be used in the honing zone will fly in all directions to be suspended (drifted) in the ambient gas in the honing zone. Thus, there is a drawback that the foreign substances such as abrasive grains and/or dirt suspended in the ambient gas will be flowed into the washing zone together with the ambient gas to contaminate the washing zone. The contamination of the washing zone causes deterioration of washing efficiency, and also causes adhesion of the flowed foreign substances to the surface of the work, resulting in poor washing.

The present invention was made in view of the aforementioned technical background, and aims to provide a liquid honing machine, a pipe manufacturing apparatus using the liquid honing machine, a liquid honing method, and a liquid honed workpiece obtained by this method.

The present invention provides the following means.

(1) A honing machine provided with a honing zone for subjecting a work to a liquid honing process and a washing zone for subjecting the work to which the liquid honing process was executed in the honing zone to a washing process in a housing shielded from an external air, the honing zone and the washing zone being disposed adjacently, wherein a partition wall for preventing an ambient gas of the honing zone from entering into the washing zone is disposed between the honing zone and the washing zone in the housing, and wherein an in-liquid conveying apparatus for conveying the work to which the liquid honing process was executed at the honing zone from the honing zone to the washing zone via a work passing opening formed in the partition wall in a state in which the work is kept immersed in a liquid in a carrying bath.

(2) The honing machine as recited in the aforementioned Item 1, wherein an upper edge of the work passing opening of the partition wall is immersed in the liquid in the carrying bath of the in-liquid conveying apparatus.

(3) The honing machine as recited in the aforementioned Item 1 or 2, wherein the in-liquid conveying apparatus is provided with a carrying stage having a mounting plate portion for mounting the work, an arm portion upwardly protruded from the mounting plate portion, and a hanging portion formed at an upper end portion of the arm portion, wherein a rail portion extending in a work carrying direction is provided at an upper end portion of a side wall portion of the carrying bath with the rail portion not immersed in the liquid in the carrying bath, wherein the carrying stage is disposed in the carrying bath with the hanging portion hanged on the rail portion, and wherein the in-liquid conveying apparatus is configured to carry the work mounted on the mounting plate portion of the carrying stage with the work immersed in the liquid in the carrying bath by moving in the work carrying direction in a state in which the hanging portion slides on the rail portion.

(4) The honing machine as recited in the aforementioned Item 3, wherein a moving passage of the hanging portion and the rail portion are covered with a cover member which prevents dust to be generated in accordance with a sliding movement of the hanging portion on the rail portion from flying outside.

(5) The honing machine as recited in the aforementioned Item 4, wherein a lower end portion of a side wall portion of the cover member at an inner side of the carrying bath is kept immersed in the liquid in the carrying bath.

(6) The honing machine as recited in any one the aforementioned Items 1 to 5, wherein the in-liquid carrying apparatus is provided with bubble generation means for generating bubbles by spouting a gas into the liquid in the carrying bath.

(7) The honing machine as recited in any one the aforementioned Items 1 to 6, wherein the in-liquid conveying apparatus is provided with a spouting nozzle for spouting the liquid into the carrying bath so that the liquid flows in a direction opposite to the work carrying direction in the carrying bath.

(8) The honing machine as recited in the aforementioned Item 7, wherein the spouting nozzle is disposed at a side of the washing zone in the carrying bath.

(9) The honing machine as recited in any one the aforementioned Items 1 to 8, wherein the in-liquid conveying apparatus is configured such that the liquid in the carrying bath overflows from an upper end of the side wall portion at the side of the honing zone of the carrying bath.

(10) The honing machine as recited in any one of the aforementioned Items 1 to 9, wherein the in-liquid conveying apparatus is provided with a spouting nozzle for spouting washing liquid against the work which is being raised from the liquid in the carrying bath.

(11) The honing machine as recited in any one of the aforementioned Items 1 to 10, wherein the in-liquid conveying apparatus is configured such that a bottom surface of the carrying bath is inclined upward with respect to a horizontal plane in the work carrying direction.

(12) The honing machine as recited in any one of the aforementioned Items 1 to 11, further comprising a gas supplying apparatus for supplying a clean ambient gas to the washing zone.

(13) The honing machine as recited in any one the aforementioned Items 1 to 12, further comprising a gas suction apparatus for sucking an ambient gas in the honing zone.

(14) The honing machine as recited in any one the aforementioned Items 1 to 13, wherein ambient gas pressure in the washing zone is adjusted to be higher than the ambient gas pressure of the outside of the housing.

(15) The honing machine as recited in any one the aforementioned Items 1 to 14, wherein ambient gas pressure of the washing zone is adjusted to be higher than the ambient gas pressure of the honing zone.

(16) The honing machine as recited in any one the aforementioned Items 1 to 15, wherein the honing zone includes a honing bath in which a honing portion for subjecting the work to the liquid honing process, a shower washing portion for subjecting the work to which the liquid honing process was executed at the honing portion to a shower washing process and a conveying portion for carrying the work to which the liquid honing process was executed at the honing portion from the honing portion to the shower washing portion are provided inside of the honing bath, wherein the honing bath is provided with a work introducing port, a work retrieving port, and openable and closable lids corresponding to the work introducing port and the work retrieving port respectively, and wherein a honing bath gas suction apparatus for sucking the ambient gas in the honing bath is connected to the honing bath.

(17) The honing machine as recited in any one the aforementioned Items 1 to 16, wherein disposed at the inside of the honing zone are a honing portion for subjecting the work to the liquid honing process, a first shower washing portion for subjecting the work to which the liquid honing process was executed at the honing portion to the shower washing process, and a conveying portion for carrying the work to which the liquid honing process was executed at the honing portion from the honing portion to the first shower washing portion, and further disposed in the honing zone are a first carrying apparatus for carrying the work to the honing portion, and a second carrying apparatus for carrying the work to which the washing process was executed at the first shower washing portion from the first shower washing portion to the in-liquid carrying apparatus, wherein disposed in the washing zone are a second shower washing portion for subjecting the work carried to the washing zone with the in-liquid conveying apparatus to a shower washing process, a scrub washing portion arranged in plural stages for subjecting the work to which the washing process was executed at the second shower washing portion to a scrub washing process, a third shower washing portion for subjecting the work to which the washing process was executed at the scrub washing portion to a shower washing process, an immersion washing portion for subjecting the work to which the washing process was executed at the third shower washing portion to a washing process by immersing the work in a washing liquid, a raising drying portion for subjecting the work to which the washing process was executed at the immersion washing portion to a drying process by immersing the work in a high temperature liquid and then raising the work from the high temperature liquid, and a third carrying apparatus for subsequently carrying the work carried to the washing zone with the in-liquid conveying apparatus from the in-liquid conveying apparatus to each washing portion and the raising drying portion.

(18) The honing machine as recited in the aforementioned Item 17, wherein in the scrub washing portion, a scrub washing apparatus is disposed, wherein the scrub washing apparatus is provided with a work rotationally driving apparatus for driving the work about its axis, a cylindrical or columnar scrubbing member made of porous soft material having interconnected cells, a scrubbing member rotationally driving apparatus for rotating the scrubbing member whose surface is in contact with the surface of the work about its axis, and a pressing member for pressing against the surface of the scrubbing member at the time of the washing, and the scrub washing apparatus is configured to exude the washing liquid from an inside of the scrubbing member to an outside surface of the scrubbing member via the interconnected cells.

(19) The honing machine as recited in any one the aforementioned Items 1 to 18, wherein the used washing liquid used at the washing zone is supplied in the carrying bath of the in-liquid conveying apparatus.

(20) The honing machine as recited in any one the aforementioned Items 1 to 19, wherein a discharged liquid from the carrying bath of the in-liquid conveying apparatus is used as at least a part of the honing liquid and/or the washing liquid to be used at the honing zone.

(21) The honing machine as recited in any one the aforementioned Items 1 to 20, wherein the work is a raw pipe for precision pipes.

(22) The honing machine as recited in any one the aforementioned Items 1 to 20, wherein the work is a raw pipe for photoconductor drum substrate pipes.

(23) A honing machine provided with a honing zone for subjecting a cylindrical or columnar work to a liquid honing process and a washing zone for subjecting the work to which the liquid honing process was executed at the honing zone to a washing process, wherein the honing zone and the washing zone are disposed adjacently with each other in a housing shield from outside air, wherein a partition wall for preventing an ambient gas of the honing zone from entering into the washing zone is disposed between the honing zone and the washing zone in the housing, and wherein an in-liquid conveying apparatus for conveying the work to which the liquid honing process was executed at the honing zone from the honing zone to the washing zone via a work passing opening formed in the partition wall in a state in which the work is kept immersed in liquid in a carrying bath, wherein in the washing zone, a scrub washing portion for subjecting the work carried to the washing zone with the in-liquid conveying apparatus to a scrub washing process is disposed, wherein in the scrub washing portion, a scrub washing apparatus is disposed, and wherein the scrub washing apparatus is provided with a work rotationally driving apparatus for driving the work about its axis, a cylindrical or columnar scrubbing member made of porous soft material having interconnected cells, a scrubbing member rotationally driving apparatus for rotating the scrubbing member whose surface is in contact with the surface of the work about its axis, and a pressing member for pressing against the surface of the scrubbing member at the time of the washing, and the scrub washing apparatus is configured to exude the washing liquid from an inside of the scrubbing member to an outside surface of the scrubbing member via the interconnected cells.

(24) The honing machine as recited in the aforementioned Item 23, wherein the scrub member rotationally driving apparatus of the scrub washing apparatus is configured such that a circumferential speed of the scrubbing member can be controlled so as to fall at least within the range of from 0 to 650 mm/s, and wherein the work rotationally driving apparatus is configured such that a circumferential speed of the work can be controlled so as to fall at least within the range of from 0 to 300 mm/s.

(25) The honing machine as recited in the aforementioned Item 23 or 24, wherein the surface of the scrubbing member of the scrub washing apparatus is configured to be brought into contact with the surface of the work along the longitudinal direction of the surface of the work.

(26) The honing machine as recited in any one the aforementioned Items 23 to 25, wherein the length of the surface of the scrubbing member of the scrub washing apparatus is set to be longer than the length of the surface of the work.

(27) The honing machine as recited in any one the aforementioned Items 23 to 26, wherein the scrub washing apparatus is provided with a work supporting member to be attached to an end face of the work, wherein the work supporting member is configured such that the surface of the work and the peripheral surface of the work supporting member are flush with each other in a state in which the work supporting member is attached to the end face of the work.

(28) The honing machine as recited in any one the aforementioned Items 23 to 27, wherein the pressing member is inclined toward a rotational rear side of the scrubbing member in a state in which the pressing member presses against the surface of the scrubbing member of the scrub washing apparatus.

(29) The honing machine as recited in the aforementioned Item 28, wherein an angle between the pressing member of the scrub washing apparatus and the surface of the rotational direction rear side of the scrubbing member is set so as to fall within the range of from 10 to 45°.

(30) The honing machine as recited in any one the aforementioned Items 23 to 29, wherein the pressing member of the scrub washing apparatus is a plate-shaped member having one side edge portion as a pressing portion.

(31) The honing machine as recited in any one the aforementioned Items 23 to 30, wherein the scrubbing member of the scrub washing apparatus is a cylindrical shape member, wherein in a hollow portion of the scrubbing member, a washing liquid supplying pipe for supplying the washing liquid into an inside of the scrubbing member is inserted in an axial direction of the scrubbing member.

(32) The honing machine as recited in the aforementioned Item 31, wherein the scrubbing member of the scrub washing apparatus is disposed vertically, wherein one of end portions of the washing liquid supplying pipe is closed, and wherein the other end portion of the washing liquid supplying pipe is connected to a washing liquid introducing pipe for introducing the washing liquid in the washing liquid supplying pipe.

(33) The honing machine as recited in any one the aforementioned Items 23 to 32, wherein the porous soft material of the scrubbing member of the scrub washing apparatus is made of any one of PVA series resin foam, polyethylene series resin foam, polyether series resin foam, vinyl acetate series resin foam and polyurethane series resin foam.

(34) The honing machine as recited in any one of the aforementioned Items 23 to 33, wherein the work is a raw pipe for precision pipes.

(35) The honing machine as recited in any one the aforementioned Items 23 to 33, wherein the work is a raw pipe for photoconductor drum substrate pipes.

(36) A pipe manufacturing apparatus equipped with a liquid honing machine for subsequently subjecting a raw pipe to a liquid honing process and a washing process, wherein the liquid honing machine as recited in any one of the aforementioned Items 1 to 35 is used as the liquid honing machine.

(37) The pipe manufacturing apparatus as recited in the aforementioned Item 36, wherein the work is a raw pipe for precision pipes.

(38) The pipe manufacturing apparatus as recited in the aforementioned Item 36, wherein the work is a raw pipe for photoconductor drum substrate pipes.

(39) A liquid honing method using a honing machine provided with a honing zone for subjecting a work to a liquid honing process and a washing zone for subjecting the work to which the liquid honing process was executed at the honing zone to a washing process in a housing shielded from an external air, the honing zone and the washing zone being disposed adjacently, wherein the honing machine is further provided with a partition wall for preventing an ambient gas of the honing zone from entering into the washing zone disposed between the honing zone and the washing zone in the housing, wherein the work to which the liquid honing process was executed at the honing zone is carried from the honing zone to the washing zone via a work passing opening formed in the partition wall in a state in which the work is kept immersed in a liquid in a carrying bath to subject the work to a washing process at the washing zone.

(40) The liquid honing method as recited in the aforementioned Item 39, wherein the work is carried to the washing zone with the work immersed in the liquid in the carrying bath while generating bubbles by spouting a gas into the liquid in the carrying bath.

(41) The liquid honing method as recited in the aforementioned Item 39 or 40, wherein the work is carried to the washing zone with the work immersed in the liquid in the carrying bath while spouting the liquid into the carrying bath such that the liquid flows in a direction opposite to the work carrying direction in the carrying bath.

(42) The liquid honing method as recited in the aforementioned Item 41, wherein the liquid is spouted into the carrying bath from the washing zone in the carrying bath.

(43) The liquid honing method as recited in any one the aforementioned Items 39 to 42, wherein the work is carried to the washing zone with the work immersed in the liquid in the carrying bath while overflowing the liquid in the carrying bath from an upper end of a side wall portion at the honing zone side of the carrying bath.

(44) The liquid honing method as recited in any one the aforementioned Items 39 to 43, wherein a washing liquid is spouted against the work while raising the work carried to the washing zone side in the carrying bath.

(45) The liquid honing method as recited in any one the aforementioned Items 39 to 44, wherein the work is subjected to the washing process at the washing zone while supplying a clean ambient gas into the washing zone.

(46) The liquid honing method as recited in any one the aforementioned Items 39 to 45, wherein the work is subjected to the washing process at the washing zone in a state in which an ambient gas pressure of the washing zone is adjusted to be higher than the ambient air pressure at the outside of the housing.

(47) The liquid honing method as recited in any one the aforementioned Items 39 to 46, wherein the work is subjected to the liquid honing process at the honing zone in a state in which the ambient gas pressure of the washing zone is adjusted to be higher than the ambient gas pressure of the honing zone.

(48) The liquid honing method as recited in any one the aforementioned Items 39 to 47, wherein in the honing zone, a honing bathe having, in its inside, a honing portion for subjecting the work to the liquid honing process, a shower washing portion for subjecting the work to which the liquid honing process was executed at the honing portion to the washing process, and a carrying portion for carrying the work to which the liquid honing process was executed at the honing portion from the honing portion to the shower washing portion is disposed, wherein in the honing zone, the work is subjected to the liquid honing process at the honing portion, then carried from the honing portion to the shower washing portion with the carrying portion, then subjected to a shower washing process at the shower washing portion, thereafter carried to the washing zone, wherein in the washing zone, the work carried to the washing zone is subjected to the shower washing process, then subjected to the scrub washing process at scrub washing portions arranged at plural stages, then subjected to the shower washing process, then subjected to the washing process by immersing the work in the washing liquid, then immersed in a high temperature liquid and then raised from the high temperature liquid to execute a dry process.

(49) The liquid honing method as recited in the aforementioned Item 48, wherein in the scrub washing portion of the washing zone, the work is subjected to the scrub washing process by rotating the work and a scrubbing member in the same direction about respective axes while exuding the washing liquid from an inside of the scrubbing member to a surface outside of the scrubbing member via the interconnected cells in a state in which the surface of the cylindrical or columnar scrubbing member made of porous soft material having interconnected cells is in contact with the surface of the work and an pressing member is pressed against the surface of the scrubbing member.

(50) The liquid honing method as recited in any one the aforementioned Items 39 to 49, wherein the used washing liquid used at the washing zone is supplied in the carrying bath.

(51) The liquid honing method as recited in any one the aforementioned Items 39 to 50, wherein a discharged liquid from the carrying bath is used as at least a part of the honing liquid and/or the washing liquid to be used at the honing zone.

(52) The liquid honing method as recited in any one the aforementioned Items 39 to 51, wherein the work is a raw pipe for precision pipes.

(53) The liquid honing method as recited in any one of the aforementioned Items 39 to 51, wherein the work is a raw pipe for photoconductor drum substrate pipes.

(54) A liquid honing method using a honing machine provided with a honing zone for subjecting a cylindrical or columnar work to a liquid honing process, and a washing zone for subjecting the work to which the liquid honing process is executed at the honing zone to a washing process, wherein the honing zone and the washing zone are disposed adjacently with each other in a housing shield from outside air, wherein a partition wall for preventing an ambient gas of the honing zone from entering into the washing zone is disposed between the honing zone and the washing zone in the housing, wherein the work to which the liquid honing process was executed at the honing zone is carried from the honing zone to the washing zone via a work passing opening formed in the partition wall in a state in which the work is kept immersed in liquid in a carrying bath, wherein in the washing zone, the work is subjected to the scrub washing process by rotating the work and a scrubbing member in the same direction about respective axes while exuding the washing liquid from an inside of the scrubbing member to an outside surface of the scrubbing member via the interconnected cells in a state in which the surface of the cylindrical or columnar scrubbing member made of porous soft material having interconnected cells is in contact with the surface of the work and a pressing member is pressed against the surface of the scrubbing member.

(55) The liquid honing method as recited in the aforementioned Item 54, wherein a circumferential speed of the scrubbing member is controlled so as to fall within the range of from 100 to 500 mm/s, and wherein a circumferential speed of the work is controlled so as to fall within the range of from 50 to 200 mm/s.

(56) The liquid honing method as recited in the aforementioned Item 54 or 55, wherein the work is subjected to the scrub washing process in a state in which the surface of the scrubbing member is in contact with the surface of the work along the longitudinal direction of the surface of the work.

(57) The liquid honing method as recited in any one the aforementioned Items 54 to 56, wherein the work is subjected to the scrub washing process in a state in which the surface of the scrubbing member is in contact with the surface of the work so that a contact width of the surface of the scrubbing member and the surface of the work falls within the range of from 5 to 30 mm.

(58) The liquid honing method as recited in any one the aforementioned Items 54 to 57, wherein a length of the surface of the scrubbing member is set to be longer than a length of the surface of the work, wherein the work is subjected to the scrub washing process in a state in which the surface of the scrubbing member is in contact with the surface of the work along the entire longitudinal direction of the surface of the work.

(59) The liquid honing method as recited in any one the aforementioned Items 54 to 58, wherein a work supporting member is connected to at least one end face of the work among both end faces so that the surface of the work and the peripheral surface of the work supporting member are flush with each other.

(60) The liquid honing method as recited in any one the aforementioned Items 54 to 59, wherein the pressing member is inclined toward a rotational rear side of the scrubbing member in a state in which the pressing member presses against the surface of the scrubbing member.

(61) The liquid honing method as recited in the aforementioned Item 60, wherein an angle between the pressing member and the surface of the rotational direction rear side of the scrubbing member is set so as to fall within the range of from 10 to 45°.

(62) The liquid honing method as recited in any one the aforementioned Items 54 to 61, wherein the work is subjected to the scrub washing process in a state in which the pressing member presses the surface of the scrubbing member so as to cause a dent of a depth of 0.5 to 5 mm.

(63) The liquid honing method as recited in any one the aforementioned Items 54 to 62, wherein the pressing member is a plate-shaped member having one side edge portion as a pressing portion.

(64) The liquid honing method as recited in any one the aforementioned Items 54 to 63, wherein the scrubbing member is a cylindrical shape member, wherein in a hollow portion of the scrubbing member, a washing liquid supplying pipe for supplying the washing liquid into an inside of the scrubbing member is inserted in an axial direction of the scrubbing member, and wherein the work is subjected to the scrub washing process while exuding the washing liquid in the washing liquid supplying pipe to the outside surface of the scrubbing member via the interconnected cells of the scrubbing member.

(65) The liquid honing method as recited in the aforementioned Item 64, wherein the scrubbing member and the work are disposed vertically, respectively, wherein one of the end portions of the washing liquid supplying pipe is closed, and wherein the other end portion of the washing liquid supplying pipe is connected to a washing liquid introducing pipe for introducing the washing liquid in the washing liquid supplying pipe.

(66) The liquid honing method as recited in any one of the aforementioned Items 54 to 65, wherein the porous soft material of the scrubbing member is made of any one of PVA series resin foam, polyethylene series resin foam, polyether series resin foam, vinyl acetate series resin foam and polyurethane series resin foam.

(67) The liquid honing method as recited in any one of the aforementioned Items 54 to 66, wherein the work is a raw pipe for precision pipes.

(68) The liquid honing method as recited in any one of the aforementioned Items 54 to 66, wherein the work is a raw pipe for photoconductor drum substrate pipes.

(69) A liquid honed article obtained by the liquid honing method as recited in any one of the aforementioned Items 39 to 68.

The present invention has the following effects.

According to the liquid honing machine of the invention as recited in the aforementioned Item [1], the work can be subjected to the liquid honing process and the washing process sequentially, resulting in improved mass productivity.

Since the partition wall is provided between the honing zone and the washing zone in the housing, it becomes possible to prevent foreign substances such as abrasive grains or dust flowing in the ambient gas in the honing zone from entering into the washing zone by the partition wall. Thus, contamination of the washing zone due to the entering of the foreign substances flowing in the ambient gas within the honing zone into the washing zone can be prevented.

Furthermore, the work to which the liquid honing process was executed at the honing zone is carried from the honing zone to the washing zone via the work passing opening of the partition wall in a state in which the work is immersed in the liquid in the carrying bath. Therefore, foreign substances such as abrasive grains or dust adhering to the work are removed by the immersion of the work in the liquid in the carrying bath when the work is being carried. Thus, the foreign substances adhering to the work is prevented from being carried into the washing zone together with the work in a state in which the foreign substances adheres to the work, which in turn can prevent contamination of the washing zone due to the introduction of the foreign substances adhering to the work into the washing zone.

In other words, according to this liquid honing machine, contamination of the washing zone due to the introduction of the foreign substances flowing in the ambient gas in the honing zone into the washing zone can be prevented. Furthermore, since the contamination of the washing zone due to the introduction of the foreign substances adhering to the work into the washing zone can be prevented, the washing zone can maintain its high clean degree. Accordingly, occurrence of poor washing can be prevented.

According to the invention as recited in the aforementioned Item [2], since the upper edge of the work passing opening of the partition wall is kept immersed in the liquid in the carrying bath of the in-liquid conveying apparatus, introduction of the foreign substances flowing in the ambient gas in the honing zone into the washing zone via the work passing opening can be assuredly prevented, which can assuredly maintain the clean degree of the washing zone.

According to the invention as recited in the aforementioned Item [3], since the rail portion is kept non-immersed in the liquid in the carrying bath, introduction of dust to be generated in accordance with the slide movement of the hanging portion on the rain portion into the liquid in the carrying bath can be prevented. Thus, contamination of the liquid in the carrying bath due to the flowing of the dust into the liquid in the carrying bath can be prevented.

According to the invention as recited in the aforementioned Item [4], since the moving passage of the hanging portion and the rail portion are covered with the cover member, the flying of the dust generated in accordance with the slide movement of the hanging portion on the rail portion toward the outside (honing zone and the washing zone) can be prevented by the cover member. Thus, the clean degree of the washing zone can be maintained more assuredly.

According to the invention as recited in the aforementioned Item [5], since the lower end portion of the side wall portion of the cover member disposed at the inside of the carrying bath is kept immersed in the liquid in the carrying bath, the flying of the dust toward the outside can be prevented assuredly.

According to the invention as recited in the aforementioned Item [6], the work is conveyed to the washing zone in a state in which the work is kept immersed in the liquid while generating bubbles into the liquid in the carrying bath by the bubble generation means. This enables effective removal of foreign substances adhering to the work at the time of carrying the work, which in turn can prevent the introduction of the foreign substances adhering to the work into the washing zone.

According to the invention as recited in the aforementioned Item [7], the work is conveyed with the work immersed in the liquid in the carrying bath while spouting the liquid into the carrying bath from the nozzles so that the liquid flows in a direction opposite to the work carrying direction in the carrying bath. Accordingly, the foreign substances removed from the work existing in the liquid in the carrying bath are moved toward the honing zone in the carrying bath by the liquid flow in the carrying bath. Thus, contamination of the washing zone can be prevented more assuredly.

According to the invention as recited in the aforementioned Item [8], by spouting the liquid from the nozzles into the carrying bath from the side of the washing zone in the carrying bath, the liquid can be spouted against the work immediately before being raised from the liquid in the carrying bath from the vicinity thereof. This improves the removal rate of foreign substances adhering to the work.

According to the invention as recited in the aforementioned Item [9], the foreign substances floating on the liquid surface in the carrying bath are overflowed to be discharged together with the liquid in the carrying bath outside the carrying bath. Accordingly, deterioration of the clean degree of the liquid in the carrying bath can be prevented, and re-adhesion of foreign substances to the work at the time of carrying the work can also be prevented. Furthermore, the foreign substances floating on the liquid surface in the carrying bath will be overflowed to be discharged not from the upper edge of the side wall portion at the side of the washing zone of the carrying bath but from the upper end of the side wall portion at the side of the honing zone. Thus, there is no fear that the washing zone will be contaminated by this discharged liquid.

According to the invention as recited in the aforementioned Item [10], by spouting the washing liquid from the nozzle against the work while raising the work from the liquid in the carrying bath, foreign substances re-adhered to the work during the carrying and/or raising of the work can be removed in the middle of raising the work.

According to the invention as recited in the aforementioned Item [11], since the bottom surface of the carrying bath is configured to be inclined with respect to the horizontal plane upwardly in the work carrying direction, foreign substances sank in the liquid in the carrying bath are moved toward the side of honing zone in the carrying bath while sliding on the bottom surface of the carrying bath. Therefore, contamination of the washing zone can be prevented more assuredly.

According to the invention as recited in the aforementioned Item [12], the washing of the work at the washing zone while supplying clean atmosphere gas in the washing zone with the gas supplying apparatuses can improve the clean degree of the washing zone at the time of the washing.

According to the invention as recited in the aforementioned Item [13], since the liquid honing machine is provided with the gas suction apparatus, foreign substances flowing in the ambient gas in the honing zone can be removed by sucking the ambient gas in the honing zone with the gas suction apparatus, to thereby improve the clean degree of the honing zone.

According to the invention as recited in the aforementioned Item [14], the washing of the work at the washing zone in a state in which the ambient gas pressure of the washing zone is adjusted to be higher than the external pressure of the outside of the housing prevents the inflow of the external ambient air of the outside of the housing into the washing zone via inevitable gaps of the housing, which makes it possible to assuredly maintain the clean degree of the washing zone.

According to the invention as recited in the aforementioned Item [15], the execution of the washing process of the work at the washing zone in a state in which the ambient gas pressure of the washing zone is adjusted to be higher than the ambient gas pressure of the honing zone can prevent the inflow of the ambient gas of the honing zone into the washing zone via inevitable gaps formed, for example, between the partition wall and the housing or between the partition wall and the carrying bath, which makes it possible to assuredly maintain the clean degree of the washing zone.

According to the invention as recited in the aforementioned Item [16], Since the honing bath having, in its inside, the honing portion, the shower washing portion and the carrying portion is disposed in the honing zone, contamination of the honing zone can be prevented during the liquid honing process.

Furthermore, by sucking the ambient gas in the honing bath with the honing bath gas suction apparatus in a state in which at least one of the work introducing port and the work retrieving port of the honing bath is opened, it becomes possible to assuredly prevent the foreign substances flowing in the ambient gas in the honing bath from flowing out to the honing zone via the at least one of the work introducing port and the work retrieving port to thereby maintain the clean degree of the honing zone.

According to the invention as recited in the aforementioned Item [17], a liquid honing process and a shower washing process are executed in the honing bath disposed at the honing zone. Therefore contamination of the honing zone can be prevented.

Furthermore, since the scrub washing process of the work is executed with the scrub washing apparatus at the scrub washing portions of the washing zone, the following effects can be achieved.

According to the invention as recited in the aforementioned Item [18], since the scrubbing member of the scrub washing apparatus is made of porous soft member having interconnected cells, by bringing the surface of the scrubbing member into contact with the surface of the work, foreign substances such as burrs, abrasive grains and dust existing on the surface of the work can be assuredly caught in the cells of the surface of the scrubbing member. Therefore, foreign substances can be assuredly removed from the surface of the work.

Furthermore, since the washing of the work is executed while exuding the washing liquid from the inside of the scrubbing member to the surface of the scrubbing member via the interconnected cells, foreign substances adhering to the surface of the scrubbing member or captured in the cells can be discharged outside by the washing liquid exuding to the surface of the scrubbing member. Furthermore, pressing the surface of the scrubbing member with the pressing member causes a large amount of exuding washing liquid for discharging foreign substances from the inside of the scrubbing member, which makes it possible to assuredly discharge foreign substances. Furthermore, at this time, it becomes a situation in which foreign substances can be easily removed, e.g., a situation in which foreign substances caught in the cells come out to the surface of the scrubbing member by the contact of the pressing member. Therefore the discharging amount of foreign substances can be increased, thereby preventing re-adhesion of foreign substances on the work surface. Furthermore, scratching on the surface of the work due to the contact of foreign substances remained in the cells of the surface of the scrubbing member to the surface of the work can be prevented. Accordingly, the incidence of surface defects of the work can be decreased.

According to the invention as recited in the aforementioned Item [19], the used washing liquid used at the washing zone can be utilized effectively.

According to the invention as recited in the aforementioned Item [20], the discharged liquid from the carrying bath can be utilized effectively.

According to the invention as recited in the aforementioned Item [21], occurrence of washing defect of a raw pipe for precision pipes can be prevented.

According to the invention as recited in the aforementioned Item [22], occurrence of washing defect of a raw pipe for photoconductive drum substrate pipes can be prevented.

According to the invention as recited in the aforementioned Item [23], the same effects as in the invention as recited in the aforementioned Item [1] can be attained.

That is, since the scrubbing member of the scrub washing apparatus is made of porous soft member having interconnected cells, by bringing the surface of the scrubbing member into contact with the surface of the work, foreign substances such as burrs, abrasive grains and dust existing on the surface of the work can be assuredly caught in the cells of the surface of the scrubbing member. Therefore, foreign substances can be assuredly removed from the surface of the work.

Furthermore, since the washing of the work is executed while exuding the washing liquid from the inside of the scrubbing member to the surface of the scrubbing member via the interconnected cells, foreign substances adhering to the surface of the scrubbing member or captured in the cells can be discharged outside by the washing liquid exuding to the surface of the scrubbing member. Furthermore, pressing the surface of the scrubbing member with the pressing member causes a large amount of exuding washing liquid for discharging foreign substances from the inside of the scrubbing member, which makes it possible to assuredly discharge foreign substances. Furthermore, at this time, it becomes a situation in which foreign substances can be easily removed, e.g., a situation in which foreign substances caught in the cells come out to the surface of the scrubbing member by the contact of the pressing member. Therefore the discharging amount of foreign substances can be increased, thereby preventing re-adhesion of foreign substances on the work surface. Furthermore, scratching on the surface of the work due to the contact of foreign substances remained in the cells of the surface of the scrubbing member to the surface of the work can be prevented. Accordingly, the incidence of surface defects of the work can be decreased.

According to the invention as recited in the aforementioned Item [24], the circumferential speed of the scrubbing member and the circumferential speed of the work can be assuredly set to respective prescribed ranges. By rotating the scrubbing member and the work about respective axes, foreign substances can be more assuredly removed from the surface of the work.

According to the invention as recited in the aforementioned Item [25], the work can be subjected to the scrub washing process in a state in which the surface of the scrubbing member is in contact with the surface of the work along the longitudinal direction of the work. Thus, the removal amount of foreign substances on the surface of the work can be increased.

According to the invention as recited in the aforementioned Item [26], foreign substances can be removed along the entire length of the surface of the work.

According to the invention as recited in the aforementioned Item [27], since the work supporting member is attached to at least one end face of the work, the work can be supported by the work supporting member. Furthermore, since the work supporting member is attached to the end face of the work such that the surface of the work and the peripheral surface of the work supporting member are flush with each other, the surface of the scrubbing member can be brought into contact with the end portion of the surface of the work, which enables assured scrub washing process of the end portion of the work.

According to the invention as recited in the aforementioned Item [28], foreign substances adhering to the surface of the scrubbing member and foreign substances caught in the cells can be discharged outside assuredly.

According to the invention as recited in the aforementioned Item [29], foreign substances adhering to the surface of the scrubbing member and foreign substances caught in the cells can be discharged outside more assuredly.

According to the invention as recited in the aforementioned Item [30], by pressing the plate-shaped pressing member against the surface of the scrubbing member, it becomes possible to assuredly exude a large amount of the washing liquid from the inside of the scrubbing member, resulting in assured discharging of foreign substances. Furthermore, the use of the plate-shaped pressing member causes easy-to-remove situation of foreign substances caught in the cells, which assuredly increases the discharge amount of foreign substances.

According to the invention as recited in the aforementioned Item [31], the washing liquid can be assuredly supplied into the inside of the scrubbing member. Furthermore, the washing liquid supplying pipe inserted in the hollow portion of the scrubbing member functions as a core (central core) for strengthening the scrubbing member, which makes it possible to assuredly bring the surface of the scrubbing member into contact with the surface of the work.

According to the invention as recited in the aforementioned Item [32], the washing liquid containing foreign substances flows downward in the axial direction on the surface of the work or scrubbing member, resulting in quick removal of foreign substances.

According to the invention as recited in the aforementioned Item [33], foreign substances can be assuredly removed from the surface of the work without causing any scratches on the surface of the work.

According to the invention as recited in the aforementioned Item [34], occurrence of washing defect of a raw pipe for precision pipes can be prevented.

According to the invention as recited in the aforementioned Item [35], occurrence of washing defect of a raw pipe for photoconductive drum substrate pipes can be prevented.

According to the invention as recited in the aforementioned Item [36], occurrence of washing defect of a raw pipe can be prevented.

According to the invention as recited in the aforementioned Item [37], occurrence of washing defect of a raw pipe for precision pipes can be prevented.

According to the invention as recited in the aforementioned Item [38], occurrence of washing defect of a raw pipe for photoconductive drum substrate pipes can be prevented.

According to the invention as recited in the aforementioned Item [39]-[53], the same effect as those in the liquid honing machine of the present invention can be attained.

According to the invention as recited in the aforementioned Item [54]-[56], the same effect as recited in the aforementioned Items [23]-[25] of the present invention can be attained.

According to the invention as recited in the aforementioned Item [57], foreign substances adhering to the surface of the work can be removed assuredly. Furthermore, it is possible to prevent the defect that occurrence of scratches on the surface of the work due to excessive pressing force of the pressing member against the surface of the work.

According to the invention as recited in the aforementioned Item [58]-[61], the same effect as recited in the aforementioned Items [26]-[29] of the present invention can be attained.

According to the invention as recited in the aforementioned Item [62], foreign substances adhering to the surface of the scrubbing member or foreign substances caught in the cells can be discharged more assuredly.

According to the invention as recited in the aforementioned Item [63]-[68], the same effect as recited in the aforementioned Items [30]-[35] of the present invention can be attained.

According to the invention as recited in the aforementioned Item [69], a high quality liquid honed article can be provided.

DETAILED DESCRIPTION OF THE PREFERRED EMBODIMENTS

Now, an embodiment of the present invention will be explained with reference to the drawings.

Figure 1:
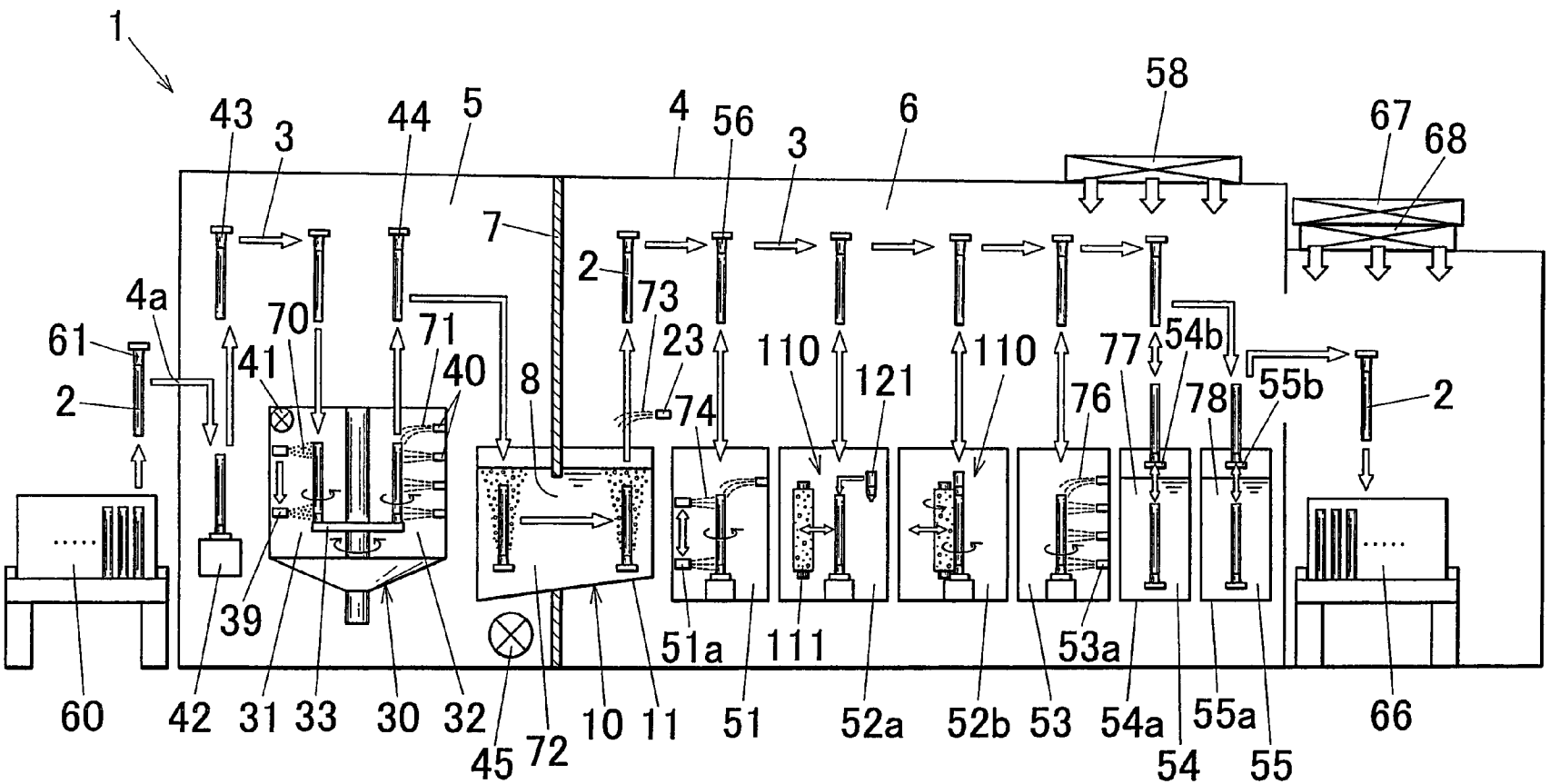
FIG. 1 is a schematic vertical cross-sectional view showing a liquid honing machine according to an embodiment of the present invention.

In FIG. 1, the reference numeral "1" denotes a liquid honing machine according to an embodiment of the present invention. The work 2 to be worked with the liquid honing machine 1 is a precision raw pipe, in detail, a raw pipe for a photoconductor drum substrate to be mounted in an electronic copying machine, a laser printer or a FAX machine, i.e., a photoconductor drum substrate raw pipe.

This work 2 (raw pipe) is a cylindrical aluminum (including its alloy) drawn pipe with a certain length obtained through a drawing process. For example, it is set that the length of this work 2 is 200 to 450 mm, the external diameter is 15 to 50 mm, and the thickness is 0.5 to 2 mm.

In the present invention, the work 2 is not limited to an aluminum one, but can be any work made of another metal or another material. Furthermore, the work 2 can be columnar in shape or any other shape.

In this embodiment, a photoconductive drum substrate pipe is manufactured by subjecting the work 2 (raw pipe) to a liquid honing process and a washing process sequentially. In other words, this liquid honing machine 1 is used to subject a work 2 (raw pipe) to a liquid honing process and a washing process sequentially in a photoconductor drum substrate pipe manufacturing apparatus.

This liquid honing machine 1 is provided with a honing zone 5 for subjecting the work 2 to a liquid honing process and a washing zone 6 for subjecting the work 2 liquid honed in the honing zone 5 to a washing process, the honing zone 5 and the washing zone 6 being disposed adjacently in a housing 4 separated form ambient air.

Between the honing zone 5 and the washing zone 6 in the housing 4, a partition wall 7 is disposed. This partition wall 7 is provided to prevent the ambient gas in the honing zone 5 from being flowed into the washing zone 6.

In this embodiment, all of the ambient gas in the honing zone 5, the ambient gas in the washing zone 6 and the ambient gas outside the housing 4 are air.

The liquid honing machine 1 is provided with an in-liquid conveying apparatus 10 having a carrying bath 11 within the housing 4.

The in-liquid carrying apparatus 10 is configured to carry the work 2 in a state in which the work is immersed in the liquid 72 in the carrying bath 11. More specifically, it is configured to carry the work 2 subjected to the liquid honing process in the honing zone 5 to the washing zone 6 by passing through the work passing opening 8 formed in the partition wall 7 from the honing zone 5 to the washing zone 6 in a state in which the work 2 is immersed in the liquid 72 in the carrying bath 11.

As the liquid 72 in the carrying bath 11, water, heated water, pure water, heated pure water, ultra pure water, heated ultra pure water, organic solvent, or liquid obtained by adding additives (e.g., surfactant, detergent) to the above can be exemplified. Furthermore, it is preferable that the liquid 72 that temperature, pH, conductivity, clean degree, etc., are set so as to fall within a prescribed range, respectively.

Figure 3:
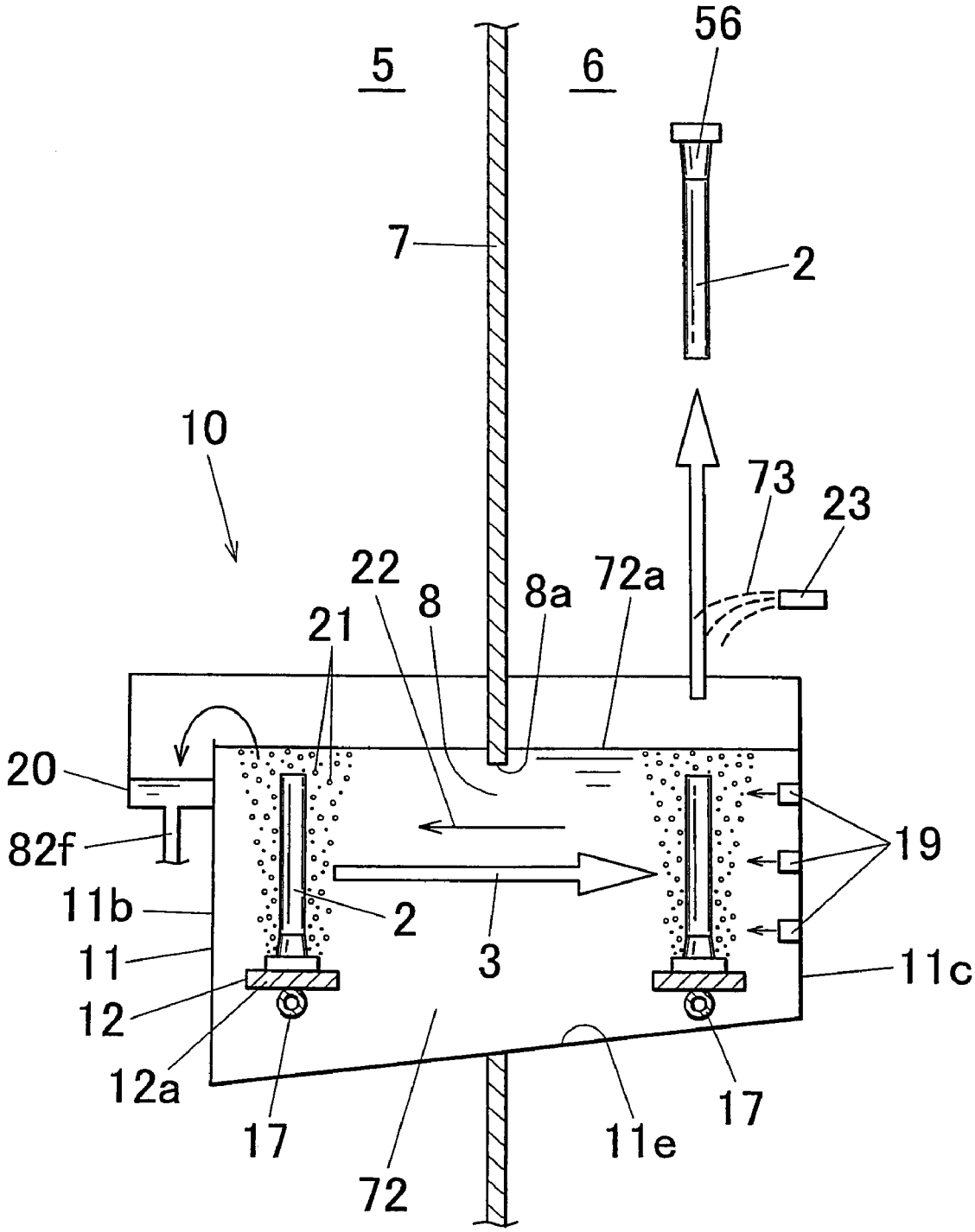
FIG. 3 is a schematic vertical cross-sectional view showing an in-fluid conveying apparatus for the liquid honing machine.

As shown in FIG. 3, the carrying bath 11 is disposed so as to bridge the honing zone 5 and the washing zone 6 via the work passing opening 8 of the partition wall 7. The upper edge 8*a* of the work passing opening 8 of the partition wall 7 is located below the liquid surface 72*a* of the liquid 72 in the carrying bath 11 to be immersed in the liquid 72 in the carrying bath 11.

Figure 4:
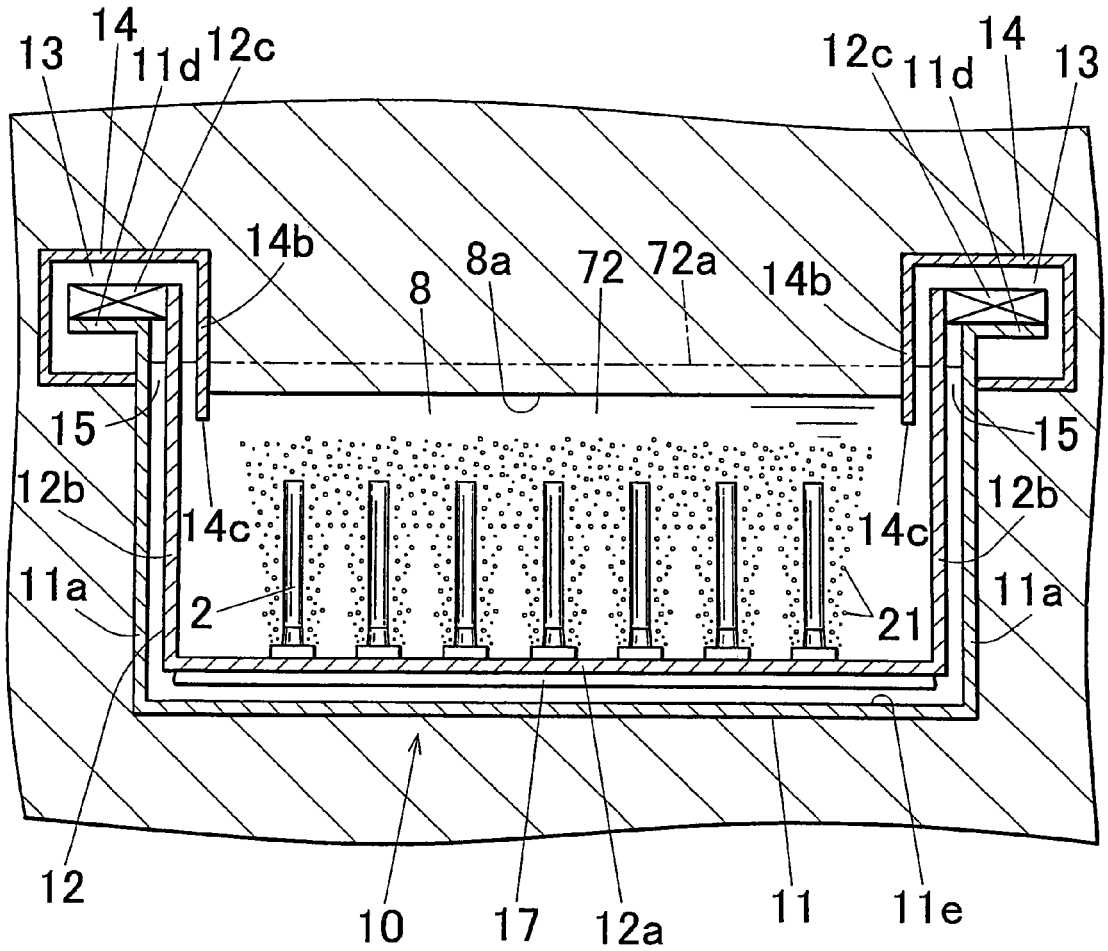
FIG. 4 is a schematic transverse cross-sectional view showing the in-fluid conveying apparatus.
Figure 5:
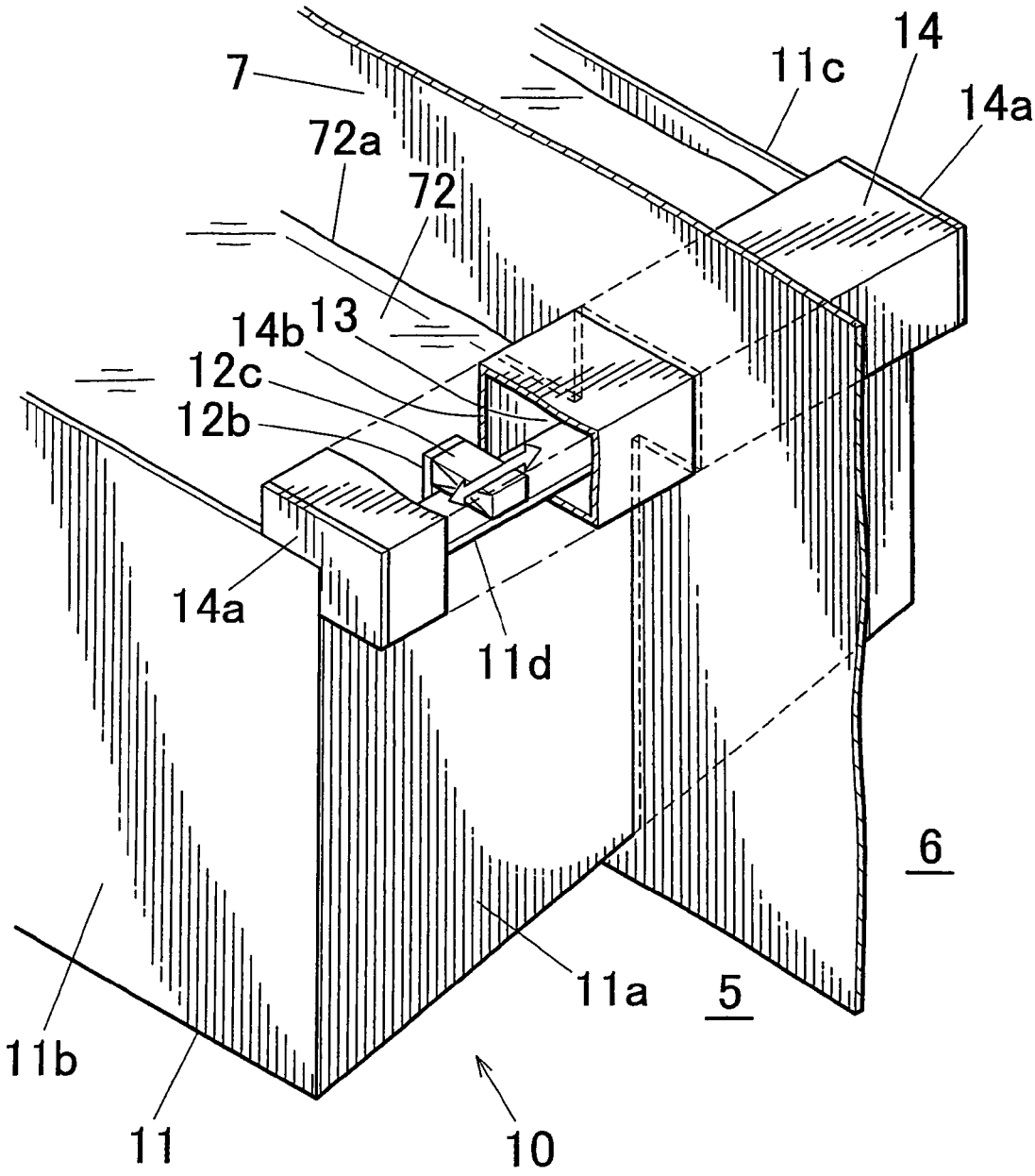
FIG. 5 is a perspective view showing a part of the in-fluid conveying apparatus.

Furthermore, as shown in FIGS. 3 to 5, the in-liquid conveying apparatus 10 is provided with a carrying stage 12. This carrying stage 12 is generally C-shape in cross-section, and is provided with a mounting plate portion 12*a* for mounting one or plural works 2 (7 works in this embodiment), arm portions 12*b* each protruded upward from the side end portion of the mounting plate portion 12*a*, and hanging portions 12*c* each protruded sideways from the upper end portion of the arm portion 12*b*. On the other hand, at the upper end portions of the right and left side wall portions 11*a* of the carrying bath 11, rail portions 11*d* protruded sideways and extended in the work carrying direction 3 is provided so as not to be immersed in the liquid 72 in the carrying bath 11. The carrying stage 12 is disposed in the carrying bath 11 in a state in which each hanging portion 12*c* is hanged on the rail portion 11*d* of the carrying bath 11. To the hanging portion 12*c*, a driving source (not shown) such as a rod-less cylinder or gas cylinder is connected. The in-liquid carrying apparatus 10 is configured to carry the works 2 mounted on the mounting plate portion 12*a* on the rail portions 11*d* in a sliding manner in a state in which the works 2 are immersed in the liquid 72 in the carrying bath 11 in accordance with the movement of the hanging portions 12*c* driven by the driving force of the driving source.

As shown in FIGS. 4 and 5, the moving passage 13 of the hanging portion 12*c* and the rail portion 11*d* are covered with a cover member 14. The cover member 14 is configured to prevent dust generated due to the slide movement of the hanging portion 12*c* on the rail portion 11*d* from flying into an outside (i.e., the honing zone 5 and the washing zone 6). Both end portions of this cover member 14 are closed by cap members 14*a*.

As shown in FIG. 4, the lower end portion 14*c* of the side wall portion 14*b* of the cover member 14 located inside the carrying bath 11 is disposed inside the carrying bath 11 so as to be away from the side wall portion 11*a* of the carrying bath 11. In the gap 15 between the lower end portion 14*c* of the side wall portion 14*b* of this cover member 14 and the side wall portion 11*a* of the carrying bath 11, the arm portion 12*b* of the carrying stage 12 is disposed. The arm portion 12*b* of the carrying stage 12 advances in the gap 15 at the time of carrying the works 2. The lower end portion 14*c* of the side wall portion 14*b* of the cover member 14 is immersed in the liquid 72 in the carrying bath 11. Thus, the inside of the cover member 14 is hermetically sealed.

Furthermore, the in-liquid conveying apparatus 10 is provided with bubble generation means 17 for blowing air as gas into the liquid 72 in the carrying bath 11 to generate bubbles 21. This bubble generation means 17 is comprised of the air permeable stone and an air supplying pipe (gas supplying pipe) for supplying air to the air permeable stone. The air supplying pipe is attached to the lower surface of the mounting plate portion 12*a* of the carrying stage 12. In this invention, the air supplying pipe itself can be made of an air permeable stone.

As shown in FIG. 3, the in-liquid conveying apparatus 10 is provided with a plurality of nozzles 19 for supplying liquid 72 into the carrying bath 11 so that the liquid 72 flows in a direction opposite to the work carrying direction 3 in the carrying bath 11. These nozzles 19 are disposed at the side of the washing zone 6 in the carrying bath 11. In detail, these nozzles 19 are disposed at the side wall portion 11*c* at the side of the washing zone 6 of the carrying bath 11 so as to face the squirt hole of the nozzle 19 in a direction opposite to the work carrying direction 3. In FIG. 3, an arrow 22 shows the flow direction of the liquid 72 in the carrying bath 11. This flow direction 22 of the liquid 72 is a direction opposite to the work carrying direction 3 as mentioned above.

This in-liquid carrying apparatus 10 is configured such that the liquid 72 in the carrying bath 11 overflows from the upper end of the side wall portion 11*b* at the side of the honing zone 5 of the carrying bath 11. Furthermore, at the upper portion of the side wall portion 11*b* at the side of the honing zone 5 of the carrying bath 11, an overflowed liquid receiver 20 for receiving the overflowed liquid is provided. The liquid surface height in the carrying bath 11 is kept at a prescribed height by this overflow mechanism.

The in-liquid carrying bath 10 is further provided with a spouting nozzle 23. This spouting nozzle 23 is configured to spout a washing liquid 73 onto the work 2 which was forwarded to the side of the washing zone 6 in the carrying bath 11 and is being pulled out of the liquid 72 in the carrying bath 11. This spouting nozzle 23 is disposed above the carrying bath 11 in the washing zone 6, so that the washing liquid 73 spouted through this spouting nozzle 23 drops in the carrying bath 11 after hitting against the work 2 which is being pulled out.

The bottom surface 11*e* of the carrying bath 11 is inclined upwardly in the work carrying direction 3 with respect to a horizontal plane. The inclination angle of this bottom surface 11*e* with respect to the horizontal plane is preferably set so as to fall within the range of from 1 to 15° (more preferably 7 to 13°). The inclination of the bottom surface 11*e* causes the movement of foreign substances went down and accumulated on the bottom surface 11*e* toward the lowest position of the bottom surface 11*e*, i.e., toward the side of the honing zone 5 in the carrying bath 11. Providing a discharging pore at the lowest position of the bottom surface 11*e* enables easy discharging of foreign substances. The inclination of the bottom surface 11*e* enhances the cleaning performance in the washing zone 6, and also makes it possible to keep the purification degree of the liquid 72 in the carrying bath 11. Especially, it is preferable that the inclination angle of the bottom surface 11*e* falls within the aforementioned range since the aforementioned effects can be attained sufficiently and the flow of the liquid 72 is not disturbed.

Figure 2:
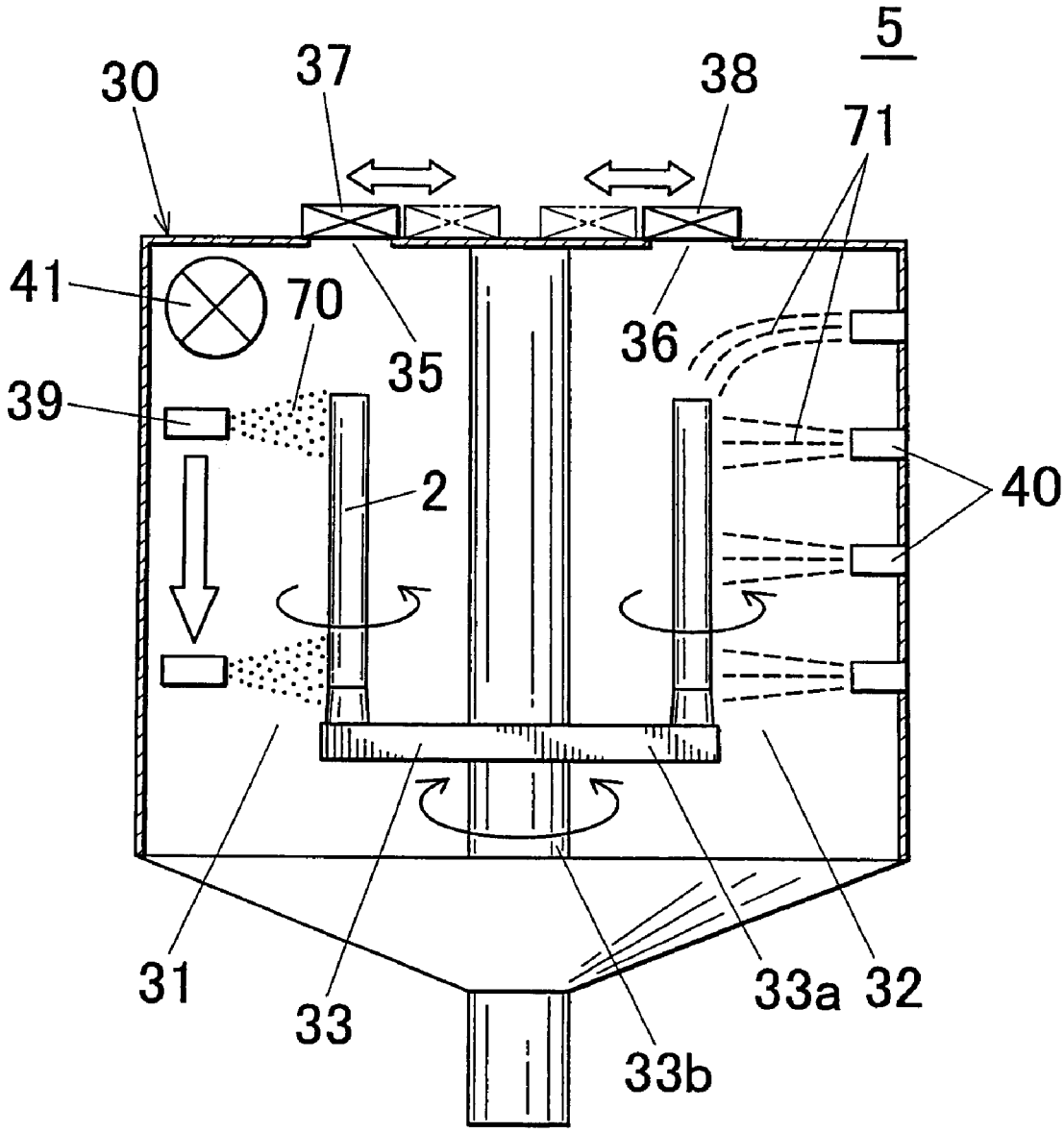
FIG. 2 is a schematic cross-sectional view showing a honing bath of the liquid honing machine.

Furthermore, as shown in FIG. 1, in the honing zone 5, a honing bath 30 is disposed. As shown in FIG. 2, this honing bath 30 is provided, in its inside, with a honing portion 31 for subjecting the work 2 to a liquid honing process, a first shower washing portion 32 for subjecting the work 2 liquid-honed at the honing portion 31 to a shower washing process as a rough washing process, and a carrying portion 33 for carrying the work 2 liquid-honed at the honing portion 31 from the honing portion 31 to a first shower washing portion 32. The carrying portion 33 is of a turn table type for example, and the reference numeral "33*a*" denotes a revolving table, "33*b*" denotes a revolving axis of the revolving table 33*a*. The inside of this honing bath 30 is shielded from the ambient gas of the honing zone 5. The ambient gas in this honing bath 30 is air.

Furthermore, this honing bath 30 is further provided with a work introducing port 35, a work retrieving port 36, and openable and closable lids 37 and 38 corresponding to respective work introducing portion 35 and work retrieving port 36. The openable and closable lids 37 and 38 can be electrically operated lids for example.

To this honing bath 30, a gas suction apparatus 41 for the honing bath for suctioning the ambient gas (air) in the honing bath 30 is connected. This gas suction apparatus 41 can be a suction blower or the like.

As shown in FIG. 1, disposed in the honing zone 5 are a work pitch changing portion 42, a first carrying apparatus 43 for carrying the work 2 whose pitch was changed by the work pitch changing portion 42 from the work pitch changing portion 42 to the honing portion 31, and a second carrying apparatus 44 for carrying the work 2 to which a shower washing process was executed at the first shower washing portion 32 from the first shower washing portion 32 to the in-liquid carrying portion 10.

In the washing zone 6, a second shower washing portion 51, two scrub washing portions 52*a* and 52*b* arranged in the work carrying direction 3, a third shower washing portion 53, an immersion washing portion 54, a raising drying portion 55 and a third carrying portion 56 are disposed.

The second shower portion 51 is configured to subject the work 2 carried to the washing zone 6 by the in-liquid carrying apparatus 10 to a shower washing process.

The two stage scrub washing portions 52*a* and 52*b* are the same in structure and configured to subject the work 2 washed at the second shower portion 51 to a scrub washing process. In each scrub washing portion 52*a* and 52*b*, a scrub washing apparatus 110 is disposed. The structure of this scrub washing apparatus 110 will be detailed later.

The third shower washing portion 53 is configured to subject the work 2 washed at the scrub washing portion 52*b* to a shower washing process.

The immersion washing portion 54 is configured to subject the work 2 washed at the third shower washing portion 53 to an immersion washing process as a finish washing process by immersing it in the washing liquid 77.

The raising drying portion 55 is configured to subject the work 3 washed at the immersion washing portion 54 to a drying process by immersing it in a high temperature liquid 78 and then raising it therefrom.

The third carrying apparatus 56 is configured to carry the work 2 carried to the washing zone 6 with the in-liquid conveying apparatus 10 from the in-liquid conveying apparatus 10 to each washing portion 51, 52*a*, 52*b*, 53 and 54 and the raising drying portion 55 in this order.

Further disposed in this washing zone 6 is a box packing portion 66 for packing the works 2 dried at the raising drying portion 55, i.e., liquid honed articles as finished works, in a box (casing). The works 2 dried at the raising drying portion 55 are conveyed from the raising drying portion 55 to this box packing portion 66 with the third carrying apparatus 56 to be packed in a box.

The liquid honing machine 1 is further provided with a plurality of gas supplying apparatuses 58 and 67 (two apparatuses in this embodiment) for supplying clean ambient gas into the washing zone 6. This gas supplying apparatus 58 is a clean unit or the like, and is mounted at the ceiling portion at the downstream side in the work carrying direction 3. In detail, the gas supplying apparatuses 58 and 67 are attached to the ceiling portion above the immersion washing portion 54 and the ceiling portion above the box packing portion 66 of the housing 4, respectively. The reference numeral "68" denotes an ionizer.

The liquid honing machine 1 is provided with a honing zone gas suction apparatus 45 for sucking the ambient gas in the honing zone 5. This gas suction apparatus 45 is comprised of a suction blower, etc., connected in communication with the honing zone 5.

The ambient gas pressure of the washing zone 6 is adjusted to be positive with respect to the atmospheric pressure of the outside of the housing 4. In this invention, it is preferable to adjust the atmospheric pressure of the washing zone 6 such that the pressure exceeds one times the atmospheric pressure of the outside of the housing 4 but does not exceed two times the atmospheric pressure (more preferably 1.1 to 1.5 times).

The ambient gas pressure of the washing zone 6 is adjusted to be positive with respect to the atmospheric pressure of the honing zone 5. In this invention, it is preferable to adjust the atmospheric pressure of the washing zone 6 such that the pressure exceeds one times the atmospheric pressure of the honing zone 5 but does not exceed two times the atmospheric pressure (more preferably 1.1 to 1.5 times).

In FIG. 1, the reference numeral "60" denotes an unprocessed work accommodating portion. This unprocessed work accommodating portion 60 is disposed at the upstream side of the work carrying direction outside the housing 4. "61" denotes a fourth carrying apparatus for carrying the unprocessed work 2 from the unprocessed work accommodating portion 60 to the work pitch changing portion 42.

In the liquid honing machine 1, each carrying apparatus 43, 44, 56 and 61 has an air-picker (not shown) and is configured to carry a plurality of works 2 at one time. In this embodiment, the picker can carry seven (7) pieces of works at one time (see FIG. 4). In this invention, the number of works 2 that each carrying apparatus 43, 44, 56 and 61 can carry at one time is not limited to 7, but can be 2 to 10, or even 1.

Next, the structure of the scrub washing apparatus 110 will be explained hereinafter.

On the surface of the liquid-honed work 2, there are generally abrasive grains contained in the honing liquid, dirt and/or fine burrs caused by collisions of abrasive grains. To remove such burrs, foreign substances such as abrasive grains or dirt from the surface of the work 2, the surface of the work 2 is subjected to a scrub washing process with the scrub washing apparatus 110.

As shown in FIGS. 7 to 11, the scrub washing apparatus 110 is provided with a cylindrical scrubbing member 111, a scrubbing member rotationally driving apparatus 115 for rotationally driving the scrubbing member 111 about its axis, a work rotationally driving apparatus 116 for rotationally driving the work 2 about its axis, and a pressing member 118 for pressing the surface (peripheral surface) of the rubbing member 111 at the time of washing. The work 2 and the rubbing member 111 are disposed in parallel with each other, vertically in this embodiment. Furthermore, as the washing liquid 120, pure water, surfactant, etc., can be used.

The scrubbing member 111 is comprised of porous soft material with interconnected cells. It is preferable to set the average cell diameter of the porous soft material such that the average cell diameter falls within the range of from 10 to 500 μm so as to make it possible to assuredly capture foreign substances such as burrs or abrasive grains or assuredly attain the flow of the washing liquid 120 (i.e., scrub washing liquid). If it is less than 10 μm, it becomes difficult to capture foreign substances in the cells and the washing fluid becomes difficult to flow therethrough. On the other hand, if it exceeds 500 μm, it becomes difficult to keep or capture the foreign substances in the cells. The preferable lower limit of the average cell diameter is 30 μm and the preferable upper limit is 300 μm. However, in this invention, the average cell diameter of the porous soft material is not limited to the range.

In the porous soft material, the softness is represented as 30% compressive stress. More specifically, it is defined by repulsive force obtained when the thickness of the porous soft material is compressed in the pressing direction by 30%. In this embodiment, the 30% compressive stress of the porous soft material preferably falls within the range of from 1.5 to 98 kPa (15 to 1,000 gf/cm$^2$). If the 30% compressive stress is less than 1.5 kPa (15 gf/cm$^2$), the porous soft material is too soft to scrub foreign substances. But if it exceeds 98 kPa (1,000 fg/cm$^2$), the porous soft material itself becomes hard excessively, which may cause scratches on the surface of the work 2. The preferable lower limit of the 30% compressive stress is 2.0 kPa (20 gf/cm$^2$), and the preferable upper limit is 49 kPa (500 gf/cm$^2$).

As the porous soft material having the aforementioned average cell diameter and 30% compressive stress, it is preferable to use any one of foam made of material selected from the group consisting of PVA series resin, polyethylene series resin, polyether series resin, vinyl acetate series resin and polyurethane series resin. The use of these resins can easily attain the aforementioned average cell diameter and 30% compressive stress. Concretely, for example, PVA foam can be exemplified as the PVA series resin foam, polyethylene foam can be exemplified as the polyethylene series resin foam, polyether foam can be exemplified as the polyether series resin foam, vinyl acetate foam can be exemplified as the vinyl acetate series resin foam, and polyurethane foam can be exemplified as the polyurethane series resin foam. It should be noted that the porous soft material is not limited to them in the present invention.

The softness of the scrubbing member 111, i.e., 30% compressive stress, depends on the cell rate, the resin polymerization degree, the content of plasticizer and the like as well as the type of resin and the average cell diameter. In this embodiment, the softness is defined by the 30% compressive stress as well as the aforementioned conditions.

Figure 9:
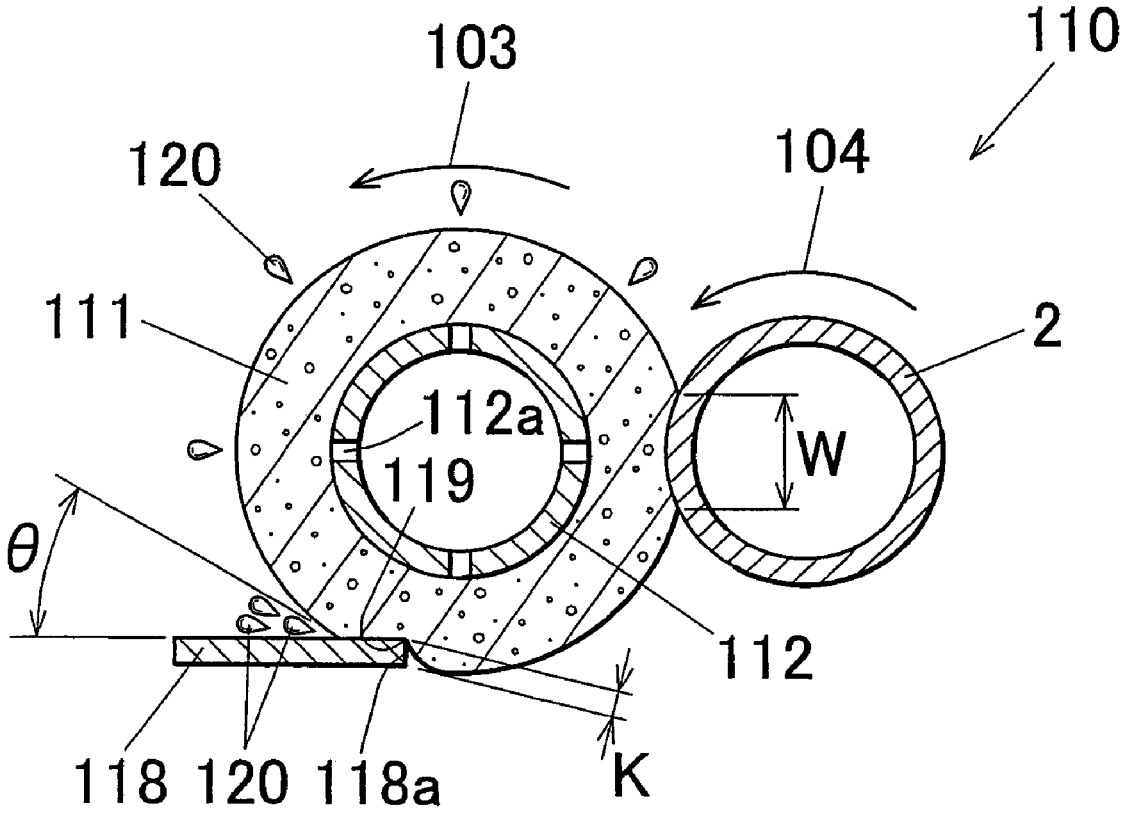
FIG. 9 is a cross-sectional view taken along the line X-X in FIG. 8.
Figure 10:
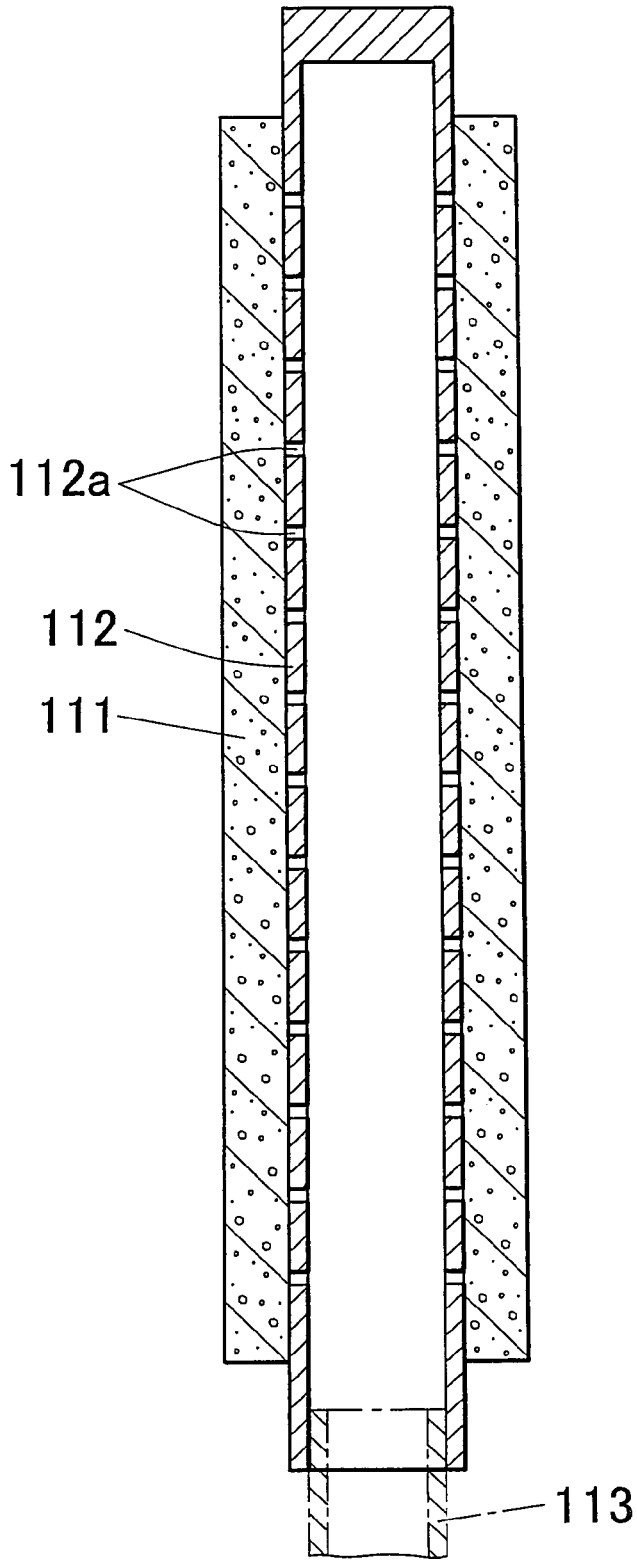
FIG. 10 is a vertical cross-sectional view showing the scrubbing member of the scrub washing apparatus.

As shown in FIGS. 9 and 10, in the hollow portion of the scrubbing member 111, a washing liquid supplying pipe 112 is tightly inserted in the axial direction of the scrubbing member 111. The washing liquid supplying pipe 112 supplies the washing liquid 120 into the scrubbing member 111. In the peripheral wall of the washing liquid supplying pipe 112, a number of washing liquid outlets 112*a* of Φ1 to 4 mm for example are formed along the axial direction and peripheral direction of the washing liquid supplying pipe 112 at certain intervals, respectively. This washing liquid supplying pipe 112 has stiffness and also functions as a core member (core bar) for strengthening the scrubbing member 111. The washing liquid supplying pipe 112 is made of, for example, resin or metal. Concretely, the axial intermediate portion of the washing liquid supplying pipe 112 is made of resin and the upper and lower end portions are made of stainless steel.

As shown in FIG. 10, the upper end portion of the washing liquid supplying pipe 112 is closed. On the other hand, the lower end portion of the washing liquid supplying pipe 112 is opened and connected to the washing liquid introducing pipe 113 for introducing the washing liquid in the washing liquid supplying pipe 112 in a liquid tight manner or a washing liquid leaking prevented manner. The washing liquid is introduced in the washing liquid supplying pipe 112 from the washing liquid introducing pipe 113. The washing liquid in the washing liquid supplying pipe 112 is supplied into the scrubbing member 111 through the washing liquid outlets 112*a*. The supplied washing liquid 120 exudes evenly to the external surface of the scrubbing member 111 via the interconnected cells along the entire surface of the scrubbing member 111.

The surface of the scrubbing member 111 is brought into contact with the surface of the work 2 along the longitudinal direction of the surface. In this embodiment, the surface length of the scrubbing member 111 is set to be longer than the surface length of the work 2, so that the surface of the scrubbing member 111 can be brought into contact with the surface of the work 2 along the entire surface length of the work 2.

Figure 11:
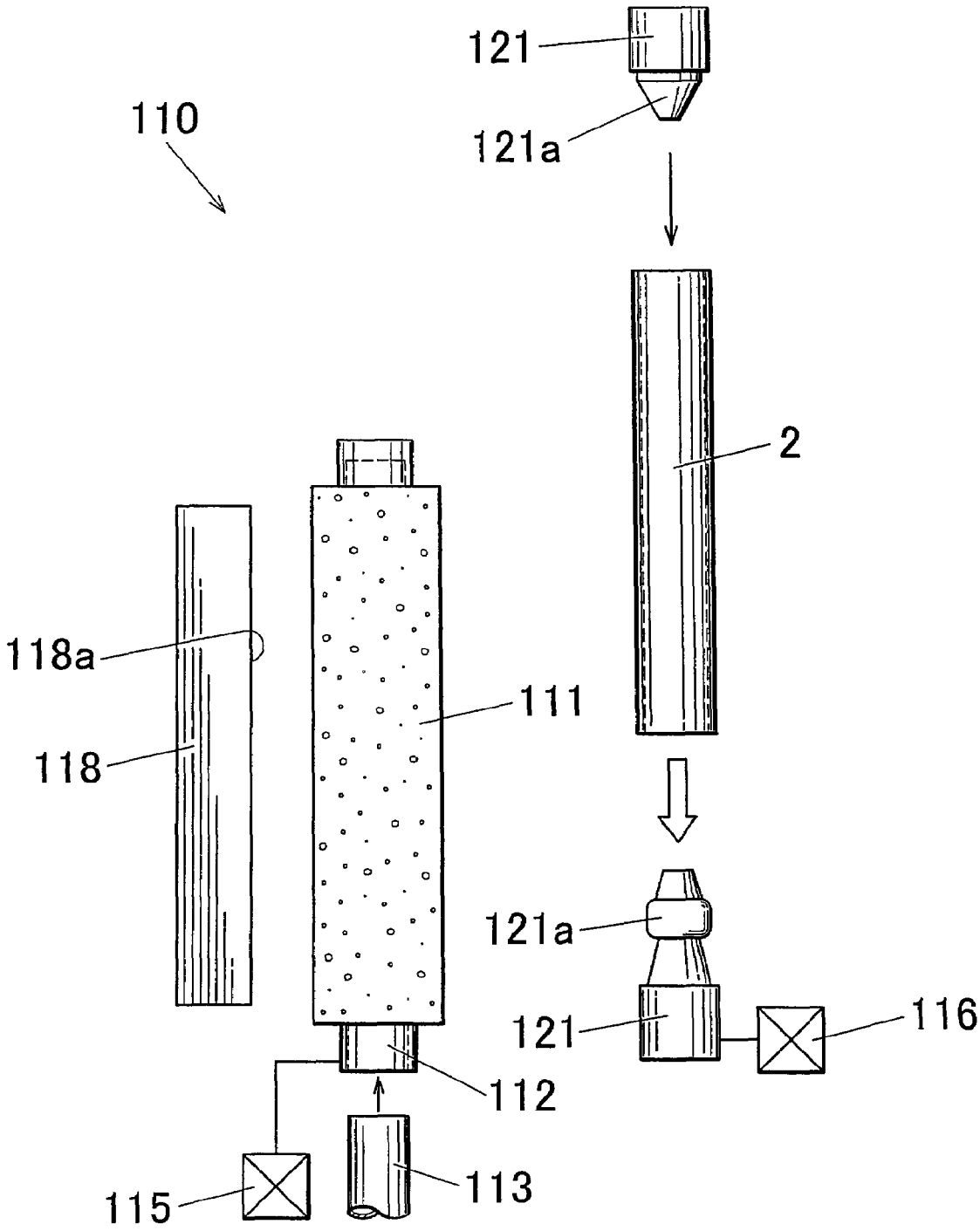
FIG. 11 is an exploded view of the scrub washing apparatus.
Figure 12A:
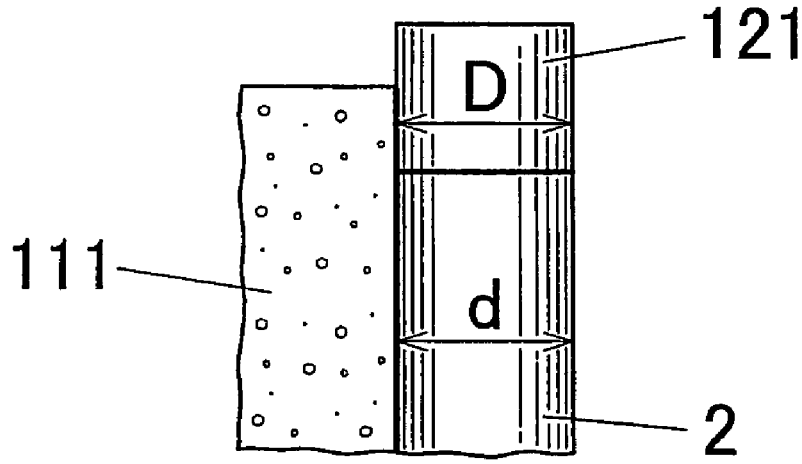
FIG. 12A is an enlarged front view mainly showing the upper end portion of the work and the work supporting member in the scrub washing apparatus.

The scrub washing apparatus 110 is further provided with a total of two upper and lower work supporting members 121 for supporting the work 2 vertically. As shown in FIG. 11, each work supporting member 121 has an engaging protruded portion 121*a* to be fitted in each end opening portion of the work 2. As shown in FIG. 12A, the diameter D of each work supporting member 121 is set to be the same as the diameter (external diameter) d of the work 2 (i.e., D=d). The engaging protruded portion 121*a* of the upper side (one side) work supporting member 121 is concentrically engaged with the upper end opened portion of the work 2, so that the upper side work supporting member 121 is attached to the upper end of the work 2. In this engaged state, the surface (external surface) of the work 2 and the peripheral surface of the upper work supporting member 121 are flush with each other along the axial direction of the work 2. In the same manner, the engaging protruded portion 121*a* of the lower side (the other side) work supporting member 121 is concentrically engaged with the lower end opened portion of the work 2, so that the lower side work supporting member 121 is attached to the lower end of the work 2. In this engaged state, the surface (external surface) of the work 2 and the peripheral surface of the lower work supporting member 121 are flush with each other along the axial direction of the work 2. Thus, the work 2 is supported vertically by two work supporting members 121 and 121.

Figure 12B:
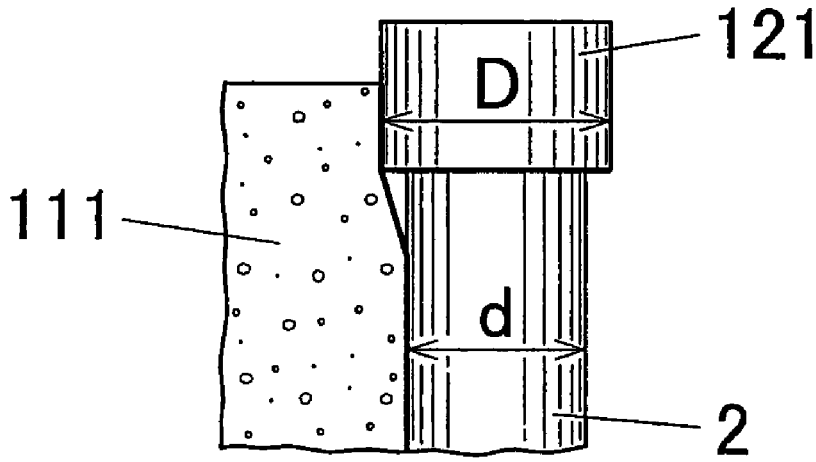
FIG. 12B is an enlarged front view corresponding to FIG. 12A in the case where the deformed work supporting member is used in FIG. 12A.

Since the surface of the work 2 and the peripheral surface of each work supporting member 121 are flush with each other, as shown in FIG. 12A, it becomes possible to assuredly bring the surface of the scrubbing member 111 into contact with the upper and lower portions of the surface of the work 2 at the time of bringing the surface of the scrubbing member 112 into contact with the surface of the work 2 along the entire surface length of the work 2. To the contrary, as shown in FIG. 12B, if the diameter D of the work supporting member 121 is set to be larger than the diameter d of the work 2 (i.e., D>d), a step is formed between the surface of the work 2 and the peripheral surface of the work supporting member 121 in a state in which the work supporting member 121 is attached to the end of the work 2. Therefore, even if the surface of the scrubbing member 111 is tried to bring into contact to the upper and lower portions of the surface of the work 2, the surface of the scrubbing member 111 cannot be brought into contact with the upper or lower end portion of the work 2 due to the stepped portion, resulting in a failure of washing of the upper and lower portions of the surface of the work 2. Accordingly, it is preferable that the surface of the work 2 is flush with the peripheral surface of the work supporting member 121 in the axial direction of the work 2 in a state in which the work supporting member 121 is attached to the end of the work 2.

The scrubbing member rotationally driving apparatus 115 has a motor (not shown) as a driving source and a control portion (not shown), and is connected to the washing liquid supplying pipe 112 of the scrubbing member 111. It is configured such that the driving of the motor causes a revolution of the scrubbing member 111 about its axis in a prescribed revolution direction 103 and that the circumferential velocity of the scrubbing member 111 is controlled by the controller.

The work rotationally driving apparatus 116 has a motor (not shown) as a driving source and a control portion (not shown), and is connected to the work supporting member 121 of the work 2. It is configured such that the driving of the motor causes a revolution of the work 2 about its axis in a prescribed revolution direction 104 and that the circumferential velocity of the work 2 is controlled by the controller.

The scrubbing member 111 and the work 2 are driven about respective axes in the same direction.

The pressing member 118 is a plate-shaped member with a linearly extended one side edge portion as a pressing portion 118*a*. This pressing member 118 has rigidity, and made of, for example, plastic or metal. The length of the pressing portion 118*a* of this pressing member 118 is preferably set to be the same as or longer than the surface length of the work 2 and to be approximately the same as the surface length of the scrubbing member 111.

The pressing member 118 presses against the surface of the scrubbing member 111 during the scrub washing process, and the pressing force is given to the pressing member 118 with elastic means (not shown) such as a spring. As shown in FIG. 9, in a state in which the pressing member 118 presses against the surface of the scrubbing member 111, the pressing member 118 is disposed such that the pressing member 118 is inclined toward the rear side of the revolution direction of the scrubbing member 111. The inclined state of the pressing member 118 is held by a holding means (not shown).

Next, a liquid honing method using the aforementioned liquid honing machine 1 will be explained.

Initially, as shown in FIG. 1, a clean ambient gas is continuously supplied into the washing zone 6 in the housing 4 by the gas supplying apparatuses 58 and 67. By this, the ambient gas pressure of the washing zone 6 is adjusted to be higher than the ambient gas pressure of the outside of the housing 4 and also to be higher than the ambient gas pressure of the honing zone 5. Furthermore, the ambient gas pressure of the honing zone 5 is also adjusted to be higher than the ambient gas pressure of the outside of the housing 4. In other words, it is adjusted such that the pressure balance meets the relation of "the washing zone 6">"the honing zone 5">"the outside of the housing 4." In this invention, for the purpose of keeping the aforementioned pressure balance, the partition wall 7 can be provided with a small gas passage (not shown) or an one-way gas passage (not shown), e.g., a gas flow passage with a damper, allowing a gas flow from the washing zone 6 to the honing zone 5. This can assuredly prevent foreign substances from being introduced from the honing zone 5 into the washing zone 6. Furthermore, in this invention, the wall of the housing 4 can be provided with a gas flow passage (not shown) allowing a gas flow from the inside of the housing 4 to the outside.

While maintaining this state, a plurality (7 pieces in this embodiment) of unprocessed works 2 accommodated in the unprocessed work accommodating portion 60 are carried at a time from the unprocessed work accommodating portion 60 to the work pitch changing portion 42 of the honing zone 5 in the housing 4 via the work introducing opening 4*a* formed in the housing 4 by the fourth carrying apparatus 61. Thereafter, the work introducing opening 4*a* is closed with an electrically driven openable and closable lid (not shown).

Next, the pitch of the plurality of works 2 carried to the work pitch changing portion 42 is changed with the work pitch changing portion 42.

Then, the works 2 are carried from the work pitch changing portion 42 to the honing portion 31 in the honing bath 30 via the work introducing port 35 by the first carrying apparatus 43. Thereafter, the work introducing port 35 and the work retrieving port 36 are closed by respective openable and closable lids 37 and 38. In this closed state, the works 2 are subjected to a liquid honing process at the honing portion 31 in accordance with a known method.

This liquid honing process will be briefly explained. As shown in FIG. 2, while rotating the work 2 about its axis, the honing liquid 70 are spouted against the surface (external peripheral surface) of the work 2 from the nozzle 39 while moving the nozzle 39 in the axial direction of the work 2. Thus, the entire surface of the work 2 is subjected to the liquid honing process to be evenly roughened.

Subsequently, the liquid-honed work 2 is carried from the honing portion 31 to the first shower washing portion 32 by the carrying portion 33.

Then, opening the work introducing port 35, an unprocessed work 2 is newly carried from the work pitch changing portion 42 to the honing portion 31 via the work introducing port 35 by the first carrying apparatus 43. Thereafter, the work introducing port 35 is closed with the openable and closable lid 37. In this closed state, the unprocessed work 2 is subjected to the liquid honing process at the honing portion 31. At the same time, the liquid-honed work 2 is subjected to a rough washing process at the first shower washing portion 32 in accordance with a known method.

This shower washing process will be briefly explained. While rotating the work 2, the washing liquid 71 is spouted against the surface of the work 2 from a plurality of nozzles 40 arranged in the axial direction of the work 2. By this, the entire surface of the work 2 is washed. At this time, the inner surface of the work 2 is also washed by spouting the washing liquid 71 into the hollow portion of the work 2.

Then, the work introducing portion 35 and the work retrieving portion 36 are opened, and the work washed at the first shower washing portion 32 is carried to the washing zone 6. That is, the work 2 is carried from the first shower washing portion 32 to the in-liquid conveying apparatus 10 with the second carrying apparatus 44 and mounted onto the mounting plate portion 12*a* of the carrying stage 12. Furthermore, the work 2 subjected to the liquid honing process at the honing portion 31 is carried from the honing portion 31 to the first shower washing portion 32 with the carrying portion 33. Thereafter, an unprocessed work 2 is newly carried to the honing portion 31 via the work introducing port 35 with the first carrying apparatus 43.

Next, the work introducing port 35 and the work retrieving port 36 are closed with respective openable and closable lids 37 and 38. In this closed state, in the same manner as mentioned above, the unprocessed work 2 is subjected to the liquid honing process at the honing portion 31. At the same time, the liquid-honed work 2 is subjected to a shower washing process at the first shower washing portion 32.

In accordance with the aforementioned steps, unprocessed works are carried from the unprocessed work accommodating portion 60 to the honing portion 5 sequentially to subject the carried work 2 to the liquid honing process and the shower washing process in the honing bath 30.

At the liquid honing process and the shower washing process in the honing bath 30 as mentioned above, when the work introducing port 35 and the work retrieving port 36 are closed with respective openable and closable lids 37 and 38, the ambient gas in the honing zone 5 is sucked by the honing bath gas suction apparatus 45 by driving it with the honing zone gas suction apparatus 41 not driven. This makes it possible to remove foreign substances floating in the ambient gas in the honing zone 5, resulting in an improved purification degree.

On the other hand, when one of the work introducing port 35 and the work retrieving port 36 is opened, the ambient gas in the honing bath 30 is sucked by the honing zone gas suction apparatus 41 by driving it with the honing bath gas suction apparatus 45 not driven. This makes it possible to prevent foreign substances floating in the ambient gas in the honing bath 30 from being flowing out to the honing zone 5 via at least one of the work introducing port 35 and the work retrieving port 36, resulting in an improved purification degree of the honing zone 5.

The work 2 mounted on the mounting plate portion 12*a* of the carrying stage 12 of the in-liquid conveying apparatus 10 will be carried to the washing zone 6 as follows.

First, as shown in FIGS. 3 and 4, bubbles 21 are made to be continuously generated in the liquid 72 in the carrying bath 11 by the bubble generation means 17. The liquid 72 is supplied by continuously spouting it from the nozzles 19 into the carrying bath 11 from the side of the washing zone 6 in the carrying bath 11 so that the liquid 72 flows in the carrying bath 11 in a direction 22 opposite to the work carrying direction 3. It is preferable that the supplied liquid 72 flows in a laminar flow manner with in the work carrying range. The flow rate can be set so as to fall within the range of, for example, from 10 to 30 liter/min. The liquid 72 in the carrying bath 11 is made to continuously overflow from the upper end of the side wall portion 11*b* of the honing zone 5 side of the carrying bath 11.

While maintaining the aforementioned state, the works 2 mounted on the mounting plate portion 12*a* of the carrying stage 12 are transferred from the honing zone 5 to the washing zone 6 via the work passing opening 8 with the works 2 immersed in the liquid 72 in the carrying bath 11. The carrying speed of the work 2 is preferably set so as to fall within the range capable of maintaining the state in which the work 2 is surrounded by bubbles 21, e.g., 50 to 100 mm/s (more preferably 60 to 90 mm/s). Furthermore, the carrying time of the work 2, i.e., the time stayed in the liquid 72, is preferably set so as to fall within the range of 15 to 40 seconds. However, in this invention, the carrying speed and time of the work 2 are not limited to the above.

Next, the following washing process is executed in the washing zone 6.

That is, while pulling the work 2 carried to the washing zone 6 out of the liquid 72 in the carrying bath 11 with the third carrying apparatus 56, the work 2 is subjected to a shower washing process by spouting the washing liquid 73 against the surface of the work 2 from the spouting nozzle 23. The spouted washing liquid 73 goes down in the carrying bath 11 after hitting to the work 2.

The work 2 is carried from the in-liquid conveying apparatus 10 to the second shower washing portion 51 with the same third carrying apparatus 56. Then, this work 2 is subjected to a shower washing process at the second shower washing portion 51 in accordance with a known method.

This shower washing process will be explained briefly. While rotating the work 2 about its axis, the spouting nozzle 51*a* is moved in the axial direction of the work 2 while spouting a washing liquid 74 from the nozzle 51*a* against the surface of the work 2. As a result, the entire surface of the work 2 will be washed. At this time, the inner surface of the work 2 is also washed by spouting the washing liquid 74 into the hollow portion of the work 2.

Next, the work 2 to which the shower washing process was executed at the second shower washing portion 51 is carried from the second shower washing portion 51 to a first stage scrub washing portion 52*a* among two stages scrub washing portions 52*a* and 52*b* with the third carrying apparatus 56. The work 2 is subjected to the scrub washing process at the first stage scrub washing portion 52*a* by the scrub washing apparatus 110.

The detail explanation of this scrub washing method will be made later.

Then, the work 2 to which the scrub washing process was executed at the first stage scrub washing portion 52*a* is carried from the first stage scrub washing portion 52*a* to the second stage scrub washing portion 52*a* with the third carrying apparatus 56. The work 2 is subjected to the scrub washing process at the second stage scrub washing portion 52*b* with the scrub washing apparatus 110 in the same manner as at the first stage scrub washing portion 52*a*.

Next, the work 2 to which the scrub washing process was executed at the second stage scrub washing portion 52*b* is carried from the second stage scrub washing portion 52*b* to the third shower washing portion 53 with the third carrying apparatus 56. The work 2 is subjected to the shower washing process at the third shower washing portion 53 in accordance with a know method.

This shower washing process will be briefly explained. While rotating the work 2, the washing liquid 76 is spouted against the surface of the work 2 from a plurality of nozzles 53*a* arranged in the axial direction of the work 2. By this, the entire surface of the work 2 is washed. At this time, the inner surface of the work 2 is also washed by spouting the washing liquid 76 into the hollow portion of the work 2.

Next, the work 2 to which the shower washing process was executed at the third shower washing portion 53 is carried from the third shower washing portion 53 to the immersion washing portion 54 with the third carrying apparatus 56. Then, the work 2 is subjected to an immersion washing process at the immersion washing portion 54 in accordance with a know method.

This immersion washing portion 54 will be briefly explained as follows. After disposing on the disposing stand 54*b* with the third carrying apparatus 56, the work 2 is immersed in the washing liquid 77 in the immersion washing bath 54*a* by lowering the disposing stand 54*b* to subject the work 2 to the washing process. At this time, it is preferable to move the work 2 up and down in the washing liquid 77 to improve the washing efficiency.

Then, the work 2 to which the immersion washing process was executed at the immersion washing portion 54 is carried from the immersion washing portion 54 to the raising drying portion 55 with the third carrying apparatus 56. Thereafter, the work 2 is dried at the raising drying portion 55.

The drying process will be briefly explained as follows. After disposing on the disposing stand 55*b* with the third carrying apparatus 56, the work 2 is immersed in a high temperature liquid 78 in the high temperature liquid bath 55*a* by lowering the disposing stand 55*b*. Thereafter, by raising the work 2 from the high temperature liquid 78 at a prescribed speed, the drying process is executed to the work 2. The temperature of the high temperature liquid 78 is preferably set to, e.g., 65° C. or above, and the raising speed of the work 2 is preferably set to, e.g., 1 cm/s or below. In the present invention, however, the temperature of the high temperature liquid 78 and the raising speed are not limited to the above.

Then, the work 2 to which the drying process was executed at the raising drying portion 55 is carried from the raising drying portion 55 to the box packing portion 66 with the third carrying apparatus 56. Thereafter, the work 2 is packed in a prescribed box (casing) at the box packing portion 66.

The liquid honed article processed by the aforementioned liquid honing machine 1 can be used as a photoconductor drum substrate pipe.

Next, the scrub washing method to be executed at the scrub washing portions 52*a* and 52*b* will be explained as follows.

Figure 7:
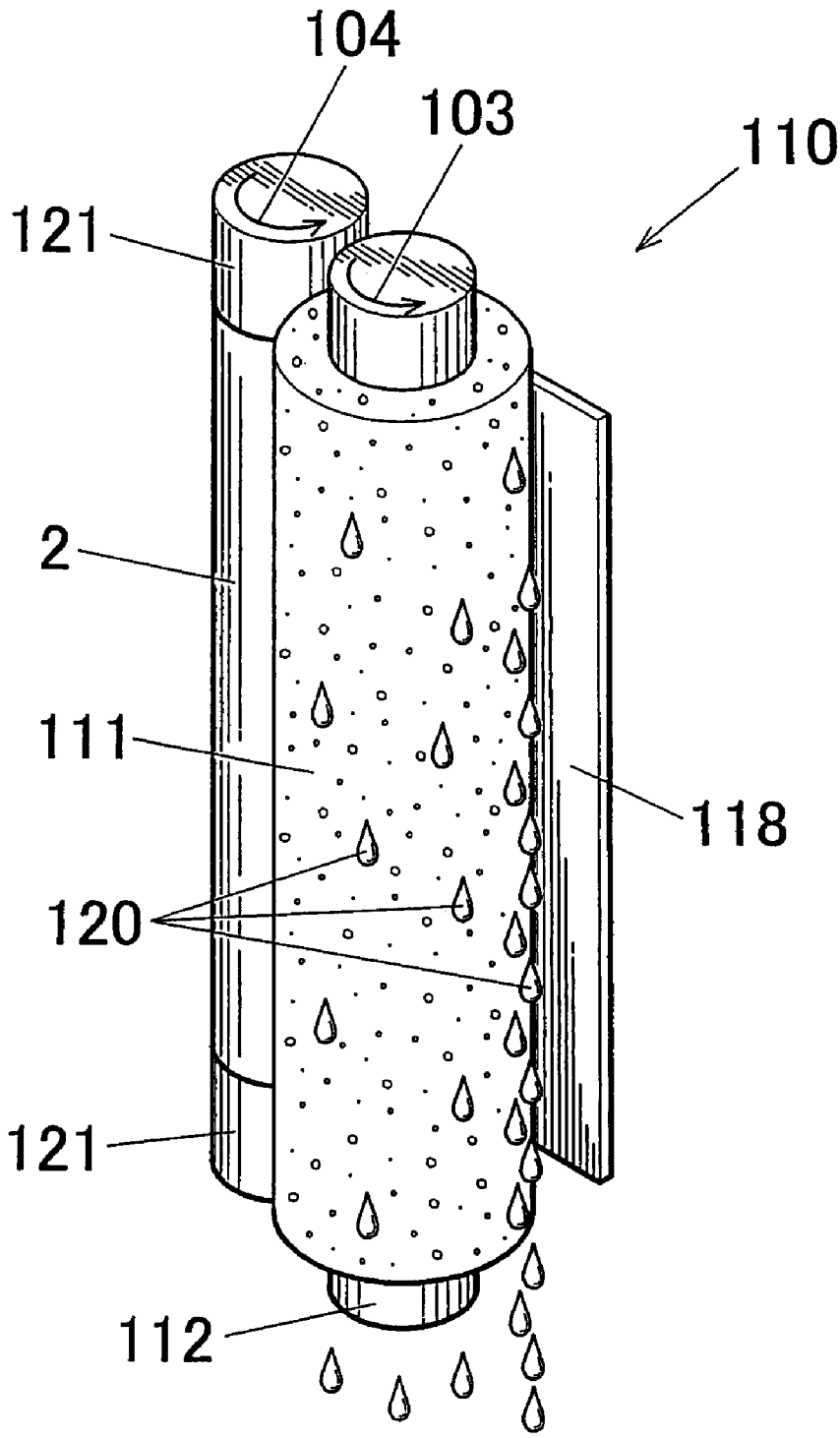
FIG. 7 is perspective view showing a scrub washing apparatus of the liquid honing machine.
Figure 8:
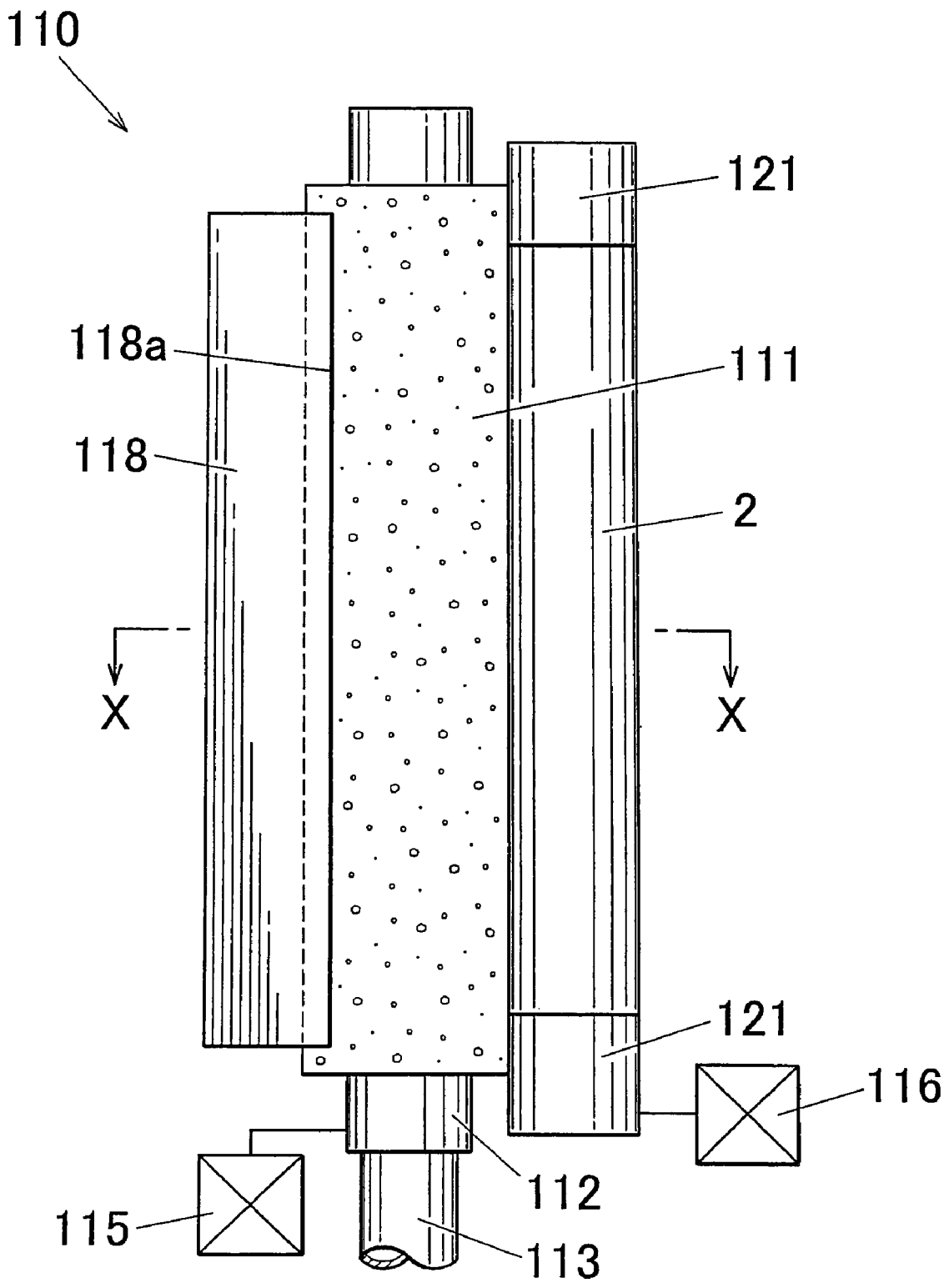
FIG. 8 is a front view showing the scrub washing apparatus.

Initially, as shown in FIGS. 7 and 8, corresponding work supporting members 121 are attached to upper and lower end faces of the work 2 so that the work 2 is supported vertically.

Then, the washing liquid is introduced from the washing liquid introducing pipe 113 to the washing liquid supplying pipe 112 at the prescribed pressure to continuously exude the washing liquid 120 in the washing liquid supplying pipe 112 to the outside surface of the scrubbing member 111 via the washing liquid outlets 112*a* and interconnected cells of the scrubbing member 111.

As shown in FIG. 8, the surface of the scrubbing member 111 is brought into contact with the surface of the work 2 by pressing against the entire length of the surface of the work 2 and the pressing portion 118*a* of the pressing member 118 is pressed against the surface of the scrubbing member 111 along the longitudinal direction of the surface of the scrubbing member 111. By this, as shown in FIG. 9, the surface of the scrubbing member 111 is pressed by the pressing member 118.

In this pressed state, while making the washing liquid 120 continuously exude outside the surface of the scrubbing member 111 as mentioned above, the scrubbing member rotationally driving apparatus 115 and the work rotationally driving apparatus 116 are driven respectively. Thus, the scrubbing member 111 and the work 2 rotate about respective axes in the same direction at respective prescribed circumferential velocity for 30 seconds to 10 minutes for example. However, in this invention, the rotating time of the scrubbing member 111 and the work 2 are not limited to the above. The circumferential velocity of the scrubbing member 111 is controlled by the control portion of the scrubbing member rotationally driving apparatus 115, and the circumferential velocity of the work 2 is controlled by the control portion of the work rotationally driving apparatus 116.

By the aforementioned operations, the entire surface of the work 2 is subjected to the scrub washing process. After the scrub washing, the work 2 is detached from the work supporting members 121 with the third carrying apparatus 56 to be transferred.

Figure 6:
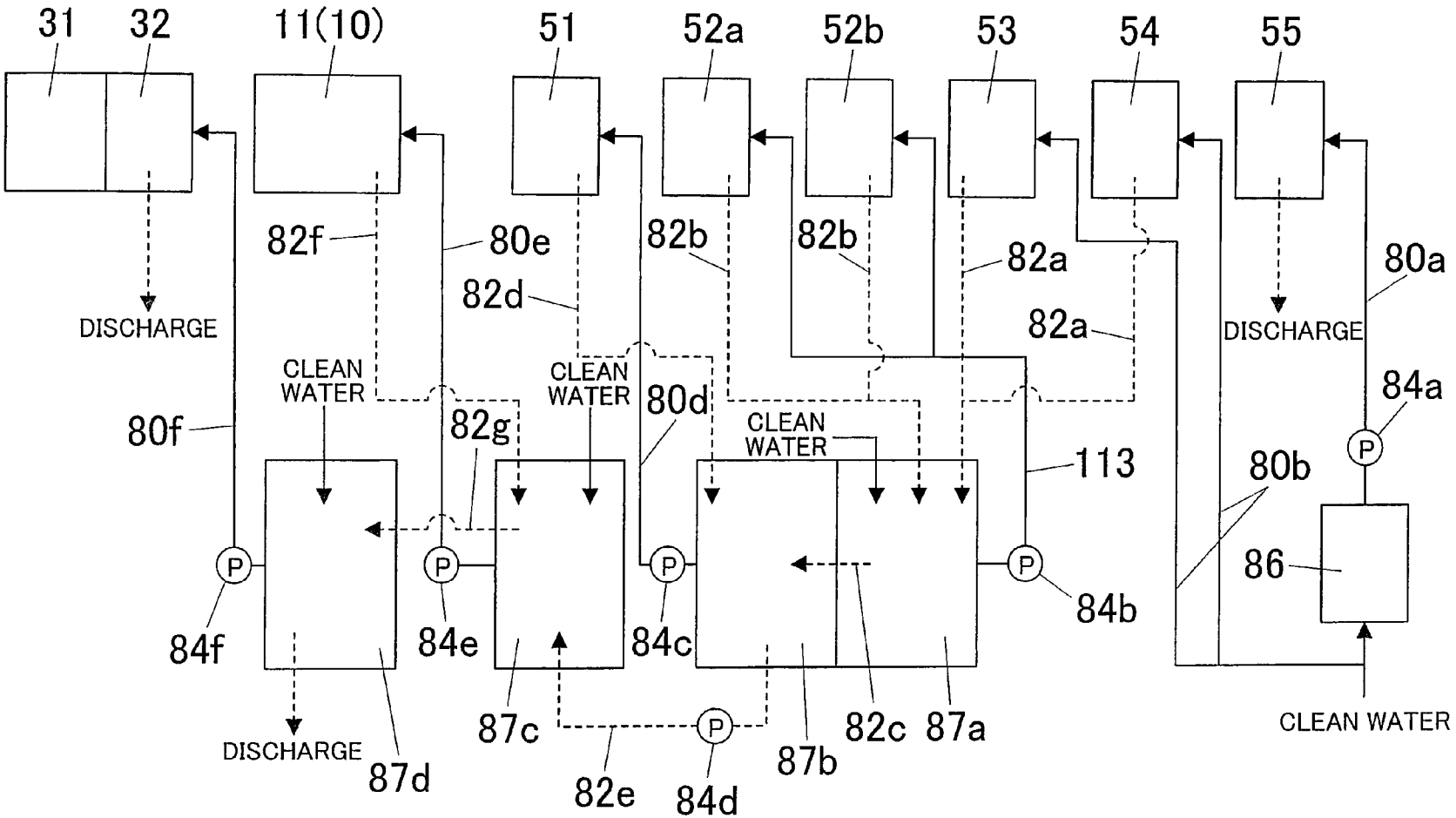
FIG. 6 is a piping diagram of the liquid honing machine.

FIG. 6 is a piping diagram of the aforementioned liquid honing machine 1. As shown in this figure, in the liquid honing machine 1, clean water as a pure water is used as the washing liquid 76 and 77 for the third shower washing portion 53 and the immersion washing portion 54 and the high temperature liquid 78 for the raising drying portion 66. In this invention, additive agent and/or liquid such as surfactant can be added to the clean water.

In cases where a high temperature liquid 78 is supplied to the raising drying portion 55, clean water is stored in the heating tank 86 to be heated to the prescribed temperature. Then, the heated clean water, i.e., the high temperature water 78, is supplied to the high temperature liquid bath 55*a* of the raising drying portion 55 via the supplying pipe 80*a* with the pump 84*a*. The high temperature liquid 78 is always overflowed outside the high temperature liquid bath 55*a* to maintain the clean degree.

To the third shower washing portion 53 and the immersion washing portion 54, clean water as the washing liquid 76 and 77 are supplied via the supplying pipe 80*b*. The used washing liquid is stored in the first collection tank 87*a* via the discharging pipe 82*a*.

The used washing liquid in the first collection tank 87*a* is supplied to the scrub washing portion 52*a* and 52*b* via the washing liquid introducing pipe 113 with the pump 84*b* as a scrub washing liquid 120. The used washing liquid used here is again stored in the first collection tank 87*a* via the discharging pipe 82*b*. To the first collection tank 87*a*, clean water is supplied appropriately.

The supernatant liquid of the used washing liquid in the first collection tank 87*a* is stored in the second collection tank 87*b* via the discharging pipe 82*c*.

The used washing liquid in the second collection tank 87*b* is supplied to the second shower washing portion 51 via the supplying pipe 80*d* via the pump 84*c* as the washing liquid 74. The used washing liquid used here is again stored in the second collection tank 87*b* via the discharging pipe 82*d*.

The supernatant liquid of the used washing liquid in the second collection tank 87*b* is stored in the third collection tank 87*c* via the discharging pipe 82*e* with the pump 84*d*.

The used washing liquid in the third collection tank 87*c* is supplied to the carrying bath 11 of the in-liquid conveying apparatus 10 by being spouted from the nozzle 19 via the supplying pipe 80*e* with the pump 84*e*. By supplying the used washing liquid used in the washing zone 6 to the carrying bath 11, the used washing liquid can be utilized effectively.

The liquid 72 supplied to the carrying bath 11 (i.e., used washing liquid) is, as shown in FIG. 3, overflowed from the upper end of the side wall portion 11*b* of the carrying bath 11 at the side of the honing zone 5 to the side of the honing zone 5 outside the carrying bath 11 to be discharged. As shown in FIG. 6, the discharged liquid from the carrying bath 11 is again stored in the third collection tank 87*c* from the overflow liquid receiver 20 via the discharging pipe 82*f*. To this third collection tank 87*c*, clean water is supplied appropriately.

The supernatant liquid of the liquid in the third collection tank 87*c* is stored in the forth collection tank 87*d* via the discharging pipe 82*g*.

The liquid in the fourth collection tank 87*d* is supplied to the first shower washing portion 32 of the honing zone 5 via the supplying pipe 80*f* with the pump 84*f*, and is used at least a part of the washing liquid 71 to be used at the first shower washing portion 32. The used liquid used here is discharged outside. Thus, the liquid in the fourth collection tank 87*d*, i.e., the liquid discharged from the carrying bath 11, is used as at least a part of the washing liquid 71 to be used at the first shower washing portion 32, which makes it possible to effectively utilize the liquid discharged from the carrying bath 11. In this invention, the liquid in the fourth collection tank 87*d* can be supplied to the honing portion 31 of the honing zone 5 to be used as at least a part of the honing liquid 70 to be used at the honing portion 31. To this fourth collection tank 87*d*, clean water is supplied appropriately.

The aforementioned liquid honing machine 1 and liquid honing method have the following advantages.

With the liquid honing machine 1, the work 2 can be subjected to the liquid honing process and the washing process sequentially, resulting in improved mass productivity.

Since the partition wall 7 is provided between the honing zone 5 and the washing zone 6 in the housing 4, it becomes possible to prevent foreign substances such as abrasive grains or dust flowing in the ambient gas in the honing zone 5 from entering into the washing zone 6 by the partition wall 7. Thus, contamination of the washing zone 6 due to the entering of the foreign substances such as flowing in the ambient gas within the honing zone 5 into the washing zone 6 can be prevented.

Furthermore, the work 2 to which the liquid honing process was executed at the honing zone 5 is carried from the honing zone 5 to the washing zone 6 via the work passing opening 8 of the partition wall 7 in a state in which the work 2 is immersed in the liquid 72 in the carrying bath 11. Therefore, foreign substances such as abrasive grains or dust adhering to the work 2 are removed by the immersion of the work in the liquid 72 in the carrying bath 11 when the work 2 is being carried. Thus, the foreign substances adhering to the work 2 is prevented from being carried into the washing zone 6 together with the work 2 in a state in which the foreign substances adheres to the work 2, which in turn can prevent contamination of the washing zone 6 due to the introduction of the foreign substances adhering to the work 2 into the washing zone 6.

In other words, according to this liquid honing machine 1, contamination of the washing zone 6 due to the introduction of the foreign substances flowing in the ambient gas in the honing zone 5 into the washing zone 6 can be prevented. Furthermore, since the contamination of the washing zone 6 due to the introduction of the foreign substances adhering to the work 2 into the washing zone 6 can be prevented, the washing zone 6 can maintain its high clean degree. Accordingly, occurrence of poor washing can be prevented.

Furthermore, since the upper edge 8*a* of the work passing opening 8 of the partition wall 7 is kept immersed in the liquid 72 in the carrying bath 11 of the in-liquid conveying apparatus 10, introduction of the foreign substances flowing in the ambient gas in the honing zone 5 into the washing zone 6 via the work passing opening 8 can be assuredly prevented, which can assuredly maintain the clean degree of the washing zone 6.

Furthermore, since the rail portion 11*d* is kept non-immersed in the liquid 72 in the carrying bath 11, introduction of dust to be generated in accordance with the slide movement of the hanging portion 12*c* on the rain portion 11*d* into the liquid 72 in the carrying bath 11 can be prevented. Thus, contamination of the liquid 72 in the carrying bath 11 due to the flowing of the dust into the liquid 72 in the carrying bath 11 can be prevented.

Furthermore, since the moving passage 13 of the hanging portion 12*c* and the rail portion 11*d* are covered with the cover member 14, the flying of the dust generated in accordance with the slide movement of the hanging portion 12*c* on the rail portion 11*d* toward the outside (honing zone 5 and the washing zone 6) can be prevented by the cover member 14. Thus, the clean degree of the washing zone 6 can be maintained more assuredly.

Furthermore, since the lower end portion of the side wall portion 14*b* of the cover member 14 disposed at the inside of the carrying bath 11 is kept immersed in the liquid 72 in the carrying bath 11, the flying of the dust toward the outside can be prevented assuredly.

The work 2 is conveyed to the washing zone 6 in a state in which the work 2 is kept immersed in the liquid 72 while generating bubbles 21 into the liquid 72 in the carrying bath 11 by the bubble generation means 17. This enables effective removal of foreign substances adhering to the work 2 at the time of carrying the work 2, which in turn can prevent the introduction of the foreign substances adhering to the work 2 into the washing zone 6.

Furthermore, the work 2 is conveyed with the work 2 immersed in the liquid 72 in the carrying bath 11 while spouting the liquid 72 into the carrying bath 11 from the nozzles 19 so that the liquid 72 flows in a direction opposite to the work carrying direction 3 in the carrying bath 11. Accordingly, the foreign substances removed from the work 2 existing in the liquid 72 in the carrying bath 11 are moved toward the honing zone 5 in the carrying bath 11 by the liquid flow in the carrying bath 11. Thus, contamination of the washing zone 6 can be prevented more assuredly.

By spouting the liquid 72 from the nozzles 19 into the carrying bath 11 from the side of the washing zone 6 in the carrying bath 11, the liquid 72 can be spouted against the work 2 immediately before being raised from the liquid 72 in the carrying bath 11 from the vicinity thereof. This improves the removal rate of foreign substances adhering to the work 2.

At the time of carrying the work 2 with the in-liquid conveying apparatus 10, the liquid 72 in the carrying bath 11 is being overflowed from the upper edge of the side wall portion 11*b* at the side of the honing zone 5 of the carrying bath 11. Accordingly, the foreign substances floating on the liquid surface in the carrying bath 11 are overflowed to be discharged together with the liquid 72 in the carrying bath 11 outside the carrying bath 11. Accordingly, deterioration of the clean degree of the liquid 72 in the carrying bath 11 can be prevented, and re-adhesion of foreign substances to the work 2 at the time of carrying the work 2 can also be prevented. Furthermore, the foreign substances floating on the liquid surface in the carrying bath 11 will be overflowed to be discharged not from the upper edge of the side wall portion 11*c* at the side of the washing zone 6 of the carrying bath 11 but from the upper end of the side wall portion 11*b* at the side of the honing zone 5. Thus, there is no fear that the washing zone 6 will be contaminated by this discharged liquid.

Furthermore, by spouting the washing liquid 73 from the nozzle 23 against the work 2 while raising the work 2 from the liquid 72 in the carrying bath 11, foreign substances re-adhered to the work 2 during the carrying and/or raising of the work 2 can be removed in the middle of raising the work 2.

Furthermore, since the bottom surface 11*e* of the carrying bath 11 is configured to be inclined with respect to the horizontal plane upwardly in the work carrying direction 3, foreign substances sank in the liquid 72 in the carrying bath 11 are moved toward the side of honing zone 5 in the carrying bath 11 while sliding on the bottom surface 11*e* of the carrying bath 11. Therefore, contamination of the washing zone 6 can be prevented more assuredly.

The washing of the work 2 at the washing zone 6 while supplying clean atmosphere gas in the washing zone 6 with the gas supplying apparatuses 58 and 67 can improve the clean degree of the washing zone 6 at the time of the washing.

Since the liquid honing machine 1 is provided with the gas suction apparatus 45, foreign substances flowing in the ambient gas in the honing zone 5 can be removed by sucking the ambient gas in the honing zone 5 with the gas suction apparatus 45, to thereby improve the clean degree of the honing zone 5.

The washing of the work 2 at the washing zone 6 in a state in which the ambient gas pressure of the washing zone 6 is adjusted to be higher than the external pressure of the outside of the housing 4 prevents the inflow of the external ambient air of the outside of the housing 4 into the washing zone 6 via inevitable gaps of the housing 4, which makes it possible to assuredly maintain the clean degree of the washing zone 6.

The execution of the washing process of the work 2 at the washing zone 6 in a state in which the ambient gas pressure of the washing zone 6 is adjusted to be higher than the ambient gas pressure of the honing zone 5 can prevent the inflow of the ambient gas of the honing zone 5 into the washing zone 6 via inevitable gaps formed, for example, between the partition wall 7 and the housing 4 or between the partition wall 7 and the carrying bath 11, which makes it possible to assuredly maintain the clean degree of the washing zone 6.

Since the honing bath 30 having, in its inside, the honing portion 31, the shower washing portion 32 and the carrying portion 33 is disposed in the honing zone 5, contamination of the honing zone 5 can be prevented during the liquid honing process.

Furthermore, by sucking the ambient gas in the honing bath 30 with the honing bath gas suction apparatus 41 in a state in which at least one of the work introducing port 35 and the work retrieving port 36 of the honing bath 30 is opened, it becomes possible to assuredly prevent the foreign substances flowing in the ambient gas in the honing bath 30 from flowing out to the honing zone 5 via the at least one of the work introducing port 35 and the work retrieving port 36 to thereby maintain the clean degree of the honing zone 5.

Furthermore, by subsequently subjecting the work 2 carried to the washing zone 6 to the shower washing process, the twice-scrub washing process, the shower washing process, the immersion washing process and the raising drying process in the washing zone 6, the washing efficiency of the work 2 can be further improved.

Furthermore, since the scrub washing process of the work 2 is executed with the scrub washing apparatus 110 at the scrub washing portions 52*a* and 52*b* of the washing zone 6, the following effects can be achieved.

That is, since the scrubbing member 111 of the scrub washing apparatus 110 is made of porous soft member having interconnected cells, by bringing the surface of the scrubbing member 111 into contact with the surface of the work 2, foreign substances such as burrs, abrasive grains and dust existing on the surface of the work 2 can be assuredly caught in the cells of the surface of the scrubbing member 111. Therefore, foreign substances can be assuredly removed from the surface of the work 2.

Furthermore, since the washing of the work 2 is executed while exuding the washing liquid 120 from the inside of the scrubbing member 111 to the surface of the scrubbing member 111 via the interconnected cells, foreign substances adhering to the surface of the scrubbing member 111 or captured in the cells can be discharged outside by the washing liquid 120 exuding to the surface of the scrubbing member 111. Furthermore, pressing the surface of the scrubbing member 111 with the pressing member 118 causes a large amount of exuding washing liquid 120 for discharging foreign substances from the inside of the scrubbing member 111, which makes it possible to assuredly discharge foreign substances. Furthermore, at this time, it becomes a situation in which foreign substances can be easily removed, e.g., a situation in which foreign substances caught in the cells come out to the surface of the scrubbing member 111 by the contact of the pressing member 118. Therefore the discharging amount of foreign substances can be increased, thereby preventing re-adhesion of foreign substances on the work surface. Furthermore, scratching on the surface of the work 2 due to the contact of foreign substances remained in the cells of the surface of the scrubbing member 111 to the surface of the work 2 an be prevented. Accordingly, the incidence of surface defects of the work 2 can be decreased.

Furthermore, by executing the washing of the work 2 while rotating the scrubbing member 111 and the work 2 in the same direction about respective axes, foreign substances can be assuredly removed from the entire peripheral surface of the work 2.

In the scrub washing method, it is preferable that the circumferential speed of the scrubbing member 111 is set so as to fall within the range of from 100 to 500 mm/s (more preferably 200 to 300 mm/s). Furthermore, it is preferable that the circumferential speed of the work 2 is set so as to fall within the range of from 50 to 200 mm/s (more preferably 75 to 150 mm/s). Setting the circumferential speed of the scrubbing member 111 and that of the work 2 to respective ranges makes it possible to remove foreign substances more assuredly.

In order to make it possible to assuredly set the circumferential speed of the scrubbing member 111 to the aforementioned range, it is preferable to configure the scrubbing member rotationally driving apparatus 115 such that the circumferential speed of the scrubbing member 111 can be controlled so as to fall within the range of at least from 0 to 650 mm/s. Furthermore, in order to make it possible to assuredly set the circumferential speed of the work 2 to the aforementioned range, it is preferable to configure the work rotationally driving apparatus 116 such that the circumferential speed of the work 2 can be controlled so as to fall within the range of at least from 0 to 300 mm/s.

The washing of the work 2 is executed in a state in which the surface of the scrubbing member 111 is in contact with the surface of the work 2 along the longitudinal length of the surface of the work 2. This makes it possible to increase the removing amount of foreign substances from the work surface.

As shown in FIG. 9, it is preferable to execute the washing of the work 2 in a state in which the surface of the scrubbing member 111 is in contact with the surface of the work 2 with the contact width W to the work surface falling with in the range of from 5 to 30 mm. If the contact width W is less than 5 mm, W is too small to obtain sufficient washing ability. On the other hand, if W exceeds 30 mm, the pressing force of the scrubbing member 111 against the work surface becomes excessively, which may cause scratches on the surface of the work 2. Accordingly, it is preferable that W falls within the range of from 5 to 30 mm. This enables assured removal of foreign substances and prevention of making scratches on the surface of the work 2 due to excessive pressing force of the scrubbing member 111 to the surface of the work 2. The more preferable range of the contact width W is from 10 to 15 mm. In the present invention, however, W is not limited to the above.

Since the washing of the work 2 is executed in a state in which the surface of the scrubbing member 111 is brought into contact with the surface of the work 2 along the entire length of the surface of the work 2, foreign substances can be removed along the entire direction of the surface of the works 2.

Furthermore, since the work supporting member 121 is connected to the end face of the work 2 with the surface of the work 2 being flush with the peripheral surface, the surface of the scrubbing member 111 can be assuredly brought into contact with the end portion of the surface of the work 2, resulting in assured washing of the end portion of the surface of the work 2.

In this scrub washing method, as shown in FIG. 6, it is preferable to dispose the pressing member 118 so as to be inclined toward the rear side of the rotational direction 103 of the scrubbing member 111 in a state in which the surface of the scrubbing member 111 is pressed with the pressing member 118. This makes it possible to assuredly discharge foreign substances adhering to the surface of the scrubbing member 111 or caught by the cells toward the outside.

Furthermore, as shown in the figure, assuming that the angle between the pressing member 118 and the surface of the scrubbing member 111 at the rotational rear side is defined as θ, it is preferable to set θ so as to fall within the range of from 10 to 45° (more preferably, 20 to 30°). In this case, foreign substances can be discharged outside more assuredly. In the present invention, it should be note that θ is not limited to the range.

Furthermore, as shown in the figure, it is preferable to press the pressing member 118 against the surface of the scrubbing member 111 so as to cause a dent 119 with a depth K of 0.5 to 5 mm (more preferably, 1 to 3 mm) in the surface thereof. In this case, foreign substances can be discharged outside more assuredly.

Furthermore, since the pressing member 118 is a plate-shaped member with one side edge portion functioning as a pressing portion 118*a*, by pressing the surface of the scrubbing member 111 with the plate-shaped pressing member 118, a large amount of the washing liquid 120 can be exude assuredly from the inside of the scrubbing member 111, enabling assured discharging of foreign substances. The use of the plate-shaped pressing member 118 causes a situation in which foreign substances caught in the cells can be removed assuredly, which in turn can assuredly increase the discharge amount of foreign substances.

Since the washing liquid supplying pipe 112 is inserted in the hollow portion of the scrubbing member 111, the washing liquid 120 can be supplied to the inside of the scrubbing member 111 assuredly. Furthermore, since the washing liquid supplying pipe 112 inserted in the hollow portion of the scrubbing member 111 functions as a core for strengthening the scrubbing member 111, the surface of the scrubbing member 111 can be assuredly brought into contact with the surface of the work 2.

Furthermore, since the work 2 and the scrubbing member 111 are disposed vertically, respectively, the washing liquid 120 containing foreign substances flows downward along the surface of the work 2 or the surface of the scrubbing member 111 at the time of washing, resulting in easy removal of foreign substances.

Furthermore, since the lower end portion of the washing liquid supplying pipe 112 is connected to the washing liquid introducing pipe 113, even if the washing liquid is leaked from the connecting portion connecting the lower end portion of the washing liquid supplying pipe 112 and the washing liquid introducing pipe 113, it becomes possible to prevent defects that the surface of the scrubbing member 111 is contaminated with the washing liquid containing foreign substances.

Although one embodiment of the present invention was explained above, the invention is not limited to the above embodiment and can be changed in various manners.

For example, the work 2 machined by the liquid honing machine according to the present invention can be a raw pipe for a precision pipe such as a lens-barrel pipe for optical instruments (e.g., camera, telescope) or a raw pipe for another use.

The number of stages of the scrub washing portions 52*a* and 52*b* to be disposed at the washing zone 6 can be three, four or more.

The work 2 is not limited to a cylindrical shaped one, but can be a columnar shaped one.

The scrubbing member 111 of the scrub washing apparatus 110 is not limited to a cylindrical shaped one, but can be a columnar shaped one.

In the scrub washing apparatus 110, it can be configured such that the lower end portion of the washing liquid supplying pipe 112 is closed and the upper end portion of the washing liquid supplying pipe 112 is connected to the washing liquid introducing pipe 113.

EXAMPLES

Next, concrete examples of the present invention and comparative examples will be explained.

Example 1

As works 2, 5,000 pieces of raw pipes for photoconductor drum pipes were prepared. Each work 2 (raw pipe) was an aluminum drawn round pipe with a length of 200 to 450 mm, an external diameter of 15 to 50 mm, and a thickness of 0.2 to 2 mm. Each work 2 was subjected to a liquid honing process with the liquid honing machine 1 of the aforementioned embodiment.

Comparative Example 1

The work 2 was subjected to the liquid honing process. In this Comparative Example 1, however, no partition wall 7 is disposed between the honing zone 5 and the washing zone 6, and the work 2 was carried from the honing zone 5 to the washing zone 6 without using the in-liquid conveying apparatus 10. The other conditions were the same as those in Example 1.

As to the works 2 to which the liquid honing process was executed in accordance with Example 1 and Comparative Example 1, the washing percent defective were examined.

As a result, in Comparative Example 1, the washing percent defective of the work 2 was 1.5%. On the other hand, in Example 1, the washing percent defective of the work 2 was 0.05%. Accordingly, it was confirmed that the liquid honing process of the work 2 with the liquid honing machine 1 can decrease the washing percent defective considerably.

The washing percent defective was obtained as follows.

As to the raw pipe for photoconductor drum pipes as a work 2, a visual appearance inspection was performed under yellow lamp lighting, and the accepted works were subjected to the liquid honing process with the liquid honing machine 1 according to the aforementioned embodiment.

Then, as to the liquid honed works 2, a visual appearance inspection was performed again under yellow lamp lighting. The existence of adhesion of abrasive grains and scratches due to the scrubbing washing were examined to discriminate works with no adhesion of abrasive grains and no scratch as accepted products and works with adhesion of abrasive grains or scratches as defective products.

Examples 2 to 16

As works 2, 5,000 pieces of raw pipes for photoconductor drum pipes were prepared. Each work 2 (raw pipe) was an aluminum drawn round pipe with a length of 200 to 450 mm, an external diameter of 15 to 50 mm, and a thickness of 0.5 to 2 mm. Each work 2 was subjected to a liquid honing process with the liquid honing machine 1 of the aforementioned embodiment. Then, the rate of occurrence of defects due to scratches extending in the peripheral direction on the surface of the work 2 was examined. The results are shown in Table 1.

The scrubbing member 111 used in the scrub washing process among the liquid honing processes was a porous soft material with interconnected cells made of PVA foam whose 30% compressive stress was 8.8 kPa (90 gf/cm$^2$), average cell diameter was 200 μm. The scrub washing was executed by setting the circumferential speed of the scrubbing member 111, the circumferential speed of the work 2, the contact width W of the surface of the scrubbing member 111 to the surface of the work 2, the angle θ between the pressing member 118 and the surface of the scrubbing member 111 at the rotational rear side, and the depth K of the dent 119 of the surface of the scrubbing member 111 are set to the values respectively as shown in Table 1.

Comparative Example 2

As works 2, 5,000 pieces of the same raw pipes as in Examples 2 to 16 were prepared. The surface of the work 2 was washed at the scrub washing portions 52*a* and 52*b* according to the same scrub washing process as in Examples 2 to 16 except that no pressing member 118 was used. Then, the rate of occurrence of defects due to scratches extending in the peripheral direction on the surface of the work 2 was examined. The results are shown in Table 1.

TABLE 1

| | Circumferential speed of scrubbing member [mm/s] | Circumferential speed of work [mm/s] | Contact width W [mm] | Angle θ [°] | Depth K of dent [mm] | Percent defective [%] |
|---|---|---|---|---|---|---|
| Ex. 2 | 100 | 150 | 10 | 30 | 1 | 0.05 |
| Ex. 3 | 300 | 150 | 10 | 30 | 1 | 0.03 |
| Ex. 4 | 500 | 150 | 10 | 30 | 1 | 0.05 |
| Ex. 5 | 200 | 50 | 10 | 30 | 1 | 0.05 |
| Ex. 6 | 200 | 75 | 10 | 30 | 1 | 0.03 |
| Ex. 7 | 200 | 200 | 10 | 30 | 1 | 0.05 |
| Ex. 8 | 200 | 150 | 5 | 30 | 1 | 0.05 |
| Ex. 9 | 200 | 150 | 15 | 30 | 1 | 0.03 |
| Ex. 10 | 200 | 150 | 30 | 30 | 1 | 0.05 |
| Ex. 11 | 200 | 150 | 10 | 10 | 1 | 0.05 |

TABLE 1-continued

| | Circumferential speed of scrubbing member [mm/s] | Circumferential speed of work [mm/s] | Contact width W [mm] | Angle θ [°] | Depth K of dent [mm] | Percent defective [%] |
|---|---|---|---|---|---|---|
| Ex. 12 | 200 | 150 | 10 | 20 | 1 | 0.02 |
| Ex. 13 | 200 | 150 | 10 | 45 | 1 | 0.05 |
| Ex. 14 | 200 | 150 | 10 | 30 | 0.5 | 0.05 |
| Ex. 15 | 200 | 150 | 10 | 30 | 3 | 0.03 |
| Ex. 16 | 200 | 150 | 10 | 30 | 5 | 0.05 |
| Comp. Ex. 2 | 200 | 150 | 10 | — | — | 0.09 |

As shown in Table 1, it was confirmed that Examples 2 to 16 could decrease the percent defect as compared with Comparative Example 2.

Comparative Example 3

The work 2 was subjected to the liquid honing process. In this Comparative Example 3, however, the work 2 was subjected to the scrub washing process by the following method. That is, in the method, the surface of the work 2 was subjected to the scrub washing process by rotating the scrubbing member 111 about its axis in a state in which the scrubbing member 111 is in contact with the surface of the work 2. At the time of this washing, however, no washing liquid was made to exude from the inside of the scrubbing member 111 to the surface of the scrubbing member 111, and no pressing member 118 was used. The other conditions were the same as those in Examples 2 to 16. Then, the rate of occurrence of defects due to scratches extending in the peripheral direction on the surface of the work 2 was examined.

As a result, in Comparative Example 3, the rate of occurrence of defects by the scratches was 1.74%. The scratches were generated by the contact of the foreign substances caught by the cells on the surface of the scrubbing member 111 in accordance with the rotation of the scrubbing member 111. On the other hand, in Examples 2 to 16, the rate of occurrence of defects by the scratches was about 0% (in detail, 0.05% or less). Accordingly, it was confirmed that the rate of occurrence of defects could be decreased significantly as compared with Comparative Example 3.

It should be understood that the wordings and expressions used herein are used for the explanation purpose, should not be used to construe in a limited way, are not intended to exclude any equivalent of the features described herein, and allow various deformation falling within the aforementioned Itemed scope of this invention.

INDUSTRIAL APPLICABILITY

The present invention can be utilized for a liquid honing machine and a liquid honing method for subjecting a work such as a raw pipe for a precision pipe, a raw pipe for a photoconductor drum substrate pipe or a raw pipe for a lens-barrel pipe for optical instruments.

The present invention can be utilized for a pipe manufacturing apparatus for manufacturing a pipe such as a precision pipe, a photoconductor drum substrate pipe, or a lens-barrel pipe for optical instruments.

What is claimed is:

1. A liquid honing method using a honing machine provided with a honing zone for subjecting a work to a liquid honing process and a washing zone for subjecting the work to which the liquid honing process was executed at the honing zone to a washing process in a housing shielded from an external air, the honing zone and the washing zone being disposed adjacently, wherein the honing machine is further provided with a partition wall for preventing an ambient gas of the honing zone from entering into the washing zone disposed between the honing zone and the washing zone in the housing, wherein the work to which the liquid honing process was executed at the honing zone is carried from the honing zone to the washing zone via a work passing opening formed in the partition wall in a state in which the work is kept immersed in a liquid in a carrying bath to subject the work to a washing process at the washing zone, wherein in the honing zone, a honing bathe having, in its inside, a honing portion for subjecting the work to the liquid honing process, a shower washing portion for subjecting the work to which the liquid honing process was executed at the honing portion to the washing process, and a carrying portion for carrying the work to which the liquid honing process was executed at the honing portion from the honing portion to the shower washing portion is disposed, wherein in the honing zone, the work is subjected to the liquid honing process at the honing portion, then carried from the honing portion to the shower washing portion with the carrying portion, then subjected to a shower washing process at the shower washing portion, thereafter carried to the washing zone, and wherein in the washing zone, the work carried to the washing zone is subjected to the shower washing process, then subjected to the scrub washing process at scrub washing portions arranged at plural stages, then subjected to the shower washing process, then subjected to the washing process by immersing the work in the washing liquid, then immersed in a high temperature liquid and then raised from the high temperature liquid to execute a dry process.

2. A liquid honing method using a honing machine provided with a honing zone for subjecting a work to a liquid honing process and a washing zone for subjecting the work to which the liquid honing process was executed at the honing zone to a washing process in a housing shielded from an external air, the honing zone and the washing zone being disposed adjacently, wherein the honing machine is further provided with a partition wall for preventing an ambient gas of the honing zone from entering into the washing zone disposed between the honing zone and the washing zone in the housing, wherein the work to which the liquid honing process was executed at the honing zone is carried from the honing zone to the washing zone via a work passing opening formed in the partition wall in a state in which the work is kept immersed in a liquid in a carrying bath to subject the work to a washing process at the washing zone, wherein the work is carried to the washing zone with the work immersed in the liquid in the carrying bath while generating bubbles by spouting a gas into the liquid in the carrying bath.

3. A liquid honing method using a honing machine provided with a honing zone for subjecting a work to a liquid honing process and a washing zone for subjecting the work to which the liquid honing process was executed at the honing zone to a washing process in a housing shielded from an external air, the honing zone and the washing zone being disposed adjacently, wherein the honing machine is further provided with a partition wall for preventing an ambient gas of the honing zone from entering into the washing zone disposed between the honing zone and the washing zone in the housing, wherein the work to which the liquid honing process was executed at the honing zone is carried from the honing zone to the washing zone via a work passing opening formed in the partition wall in a state in which the work is kept immersed in a liquid in a carrying bath to subject the work to a washing process at the washing zone, wherein the work is carried to the washing zone with the work immersed in the liquid in the carrying bath while spouting the liquid into the carrying bath such that the liquid flows in a direction opposite to the work carrying direction in the carrying bath.

4. The liquid honing method as recited in claim 3, wherein the liquid is spouted into the carrying bath from the washing zone in the carrying bath.

5. A liquid honing method using a honing machine provided with a honing zone for subjecting a work to a liquid honing process and a washing zone for subjecting the work to which the liquid honing process was executed at the honing zone to a washing process in a housing shielded from an external air, the honing zone and the washing zone being disposed adjacently, wherein the honing machine is further provided with a partition wall for preventing an ambient gas of the honing zone from entering into the washing zone disposed between the honing zone and the washing zone in the housing, wherein the work to which the liquid honing process was executed at the honing zone is carried from the honing zone to the washing zone via a work passing opening formed in the partition wall in a state in which the work is kept immersed in a liquid in a carrying bath to subject the work to a washing process at the washing zone, wherein the work is carried to the washing zone with the work immersed in the liquid in the carrying bath while overflowing the liquid in the carrying bath from an upper end of a side wall portion at the honing zone side of the carrying bath.

6. A liquid honing method using a honing machine provided with a honing zone for subjecting a work to a liquid honing process and a washing zone for subjecting the work to which the liquid honing process was executed at the honing zone to a washing process in a housing shielded from an external air, the honing zone and the washing zone being disposed adjacently, wherein the honing machine is further provided with a partition wall for preventing an ambient gas of the honing zone from entering into the washing zone disposed between the honing zone and the washing zone in the housing, wherein the work to which the liquid honing process was executed at the honing zone is carried from the honing zone to the washing zone via a work passing opening formed in the partition wall in a state in which the work is kept immersed in a liquid in a carrying bath to subject the work to a washing process at the washing zone, wherein a washing liquid is spouted against the work while raising the work carried to the washing zone side in the carrying bath.

7. The liquid honing method as recited in any one of claims 2, 3, 5, 6 or 1, wherein the work is subjected to the washing process at the washing zone while supplying a clean ambient gas into the washing zone.

8. The liquid honing method as recited in any one of claims 2, 3, 5, 6 or 1, wherein the work is subjected to the washing process at the washing zone in a state in which an ambient gas pressure of the washing zone is adjusted to be higher than the ambient air pressure at the outside of the housing.

9. The liquid honing method as recited in any one of claims 2, 3, 5, 6 or 1, wherein the work is subjected to the liquid honing process at the honing zone in a state in which the ambient gas pressure of the washing zone is adjusted to be higher than the ambient gas pressure of the honing zone.

10. The liquid honing method as recited in claim 1, wherein in the scrub washing portion of the washing zone, the work is subjected to the scrub washing process by rotating the work and a scrubbing member in the same direction about respective axes while exuding the washing liquid from an inside of the scrubbing member to a surface outside of the scrubbing member via the interconnected cells in a state in which the surface of the cylindrical or columnar scrubbing member made of porous soft material having interconnected cells is in contact with the surface of the work and an pressing member is pressed against the surface of the scrubbing member.

11. The liquid honing method as recited in any one of claims 2, 3, 5, 6 or 1, wherein the used washing liquid used at the washing zone is supplied in the carrying bath.

12. The liquid honing method as recited in any one of claims 2, 3, 5, 6 or 1, wherein discharged liquid from the carrying bath is used as at least a part of the honing liquid and/or the washing liquid to be used at the honing zone.

13. The liquid honing method as recited in any one of claims 2, 3, 5, 6 or 1, wherein the work is a raw pipe for precision pipes.

14. The liquid honing method as recited in any one of claims 2, 3, 5, 6 or 1, wherein the work is a raw pipe for photoconductor drum substrate pipes.

15. A liquid honing method using a honing machine provided with a honing zone for subjecting a cylindrical or columnar work to a liquid honing process, and a washing zone for subjecting the work to which the liquid honing process is executed at the honing zone to a washing process, wherein the honing zone and the washing zone are disposed adjacently with each other in a housing shield from outside air, wherein a partition wall for preventing an ambient gas of the honing zone from entering into the washing zone is disposed between the honing zone and the washing zone in the housing, wherein the work to which the liquid honing process was executed at the honing zone is carried from the honing zone to the washing zone via a work passing opening formed in the partition wall in a state in which the work is kept immersed in liquid in a carrying bath, and wherein in the washing zone, the work is subjected to the scrub washing process by rotating the work and a scrubbing member in the same direction about respective axes while exuding the washing liquid from an inside of the scrubbing member to an outside surface of the scrubbing member via the interconnected cells in a state in which the surface of the cylindrical or columnar scrubbing member made of porous soft material having interconnected cells is in contact with the surface of the work and a pressing member is pressed against the surface of the scrubbing member.

16. The liquid honing method as recited in claim 15, wherein a circumferential speed of the scrubbing member is controlled so as to fall within the range of from 100 to 500 mm/s, and wherein a circumferential speed of the work is controlled so as to fall within the range of from 50 to 200 mm/s.

17. The liquid honing method as recited in claim 15, wherein the work is subjected to the scrub washing process in a state in which the surface of the scrubbing member is in contact with the surface of the work along the longitudinal direction of the surface of the work.

18. The liquid honing method as recited in claim 15, wherein the work is subjected to the scrub washing process in a state in which the surface of the scrubbing member is in contact with the surface of the work so that a contact width of the surface of the scrubbing member and the surface of the work falls within the range of from 5 to 30 mm.

19. The liquid honing method as recited in claim 15, wherein a length of the surface of the scrubbing member is set to be longer than a length of the surface of the work, wherein the work is subjected to the scrub washing process in a state in which the surface of the scrubbing member is in contact with the surface of the work along the entire longitudinal direction of the surface of the work.

20. The liquid honing method as recited in claim 15, wherein a work supporting member is connected to at least one end face of the work among both end faces so that the surface of the work and the peripheral surface of the work supporting member are flush with each other.

21. The liquid honing method as recited in claim 15, wherein the pressing member is inclined toward a rotational rear side of the scrubbing member in a state in which the pressing member presses against the surface of the scrubbing member.

22. The liquid honing method as recited in claim 21, wherein an angle between the pressing member and the surface of the rotational direction rear side of the scrubbing member is set to fall within the range of from 10 to 45°.

23. The liquid honing method as recited in claim 15, wherein the work is subjected to the scrub washing process in a state in which the pressing member presses the surface of the scrubbing member so as to cause a dent of a depth of 0.5 to 5 mm.

24. The liquid honing method as recited in claim 15, wherein the pressing member is a plate-shaped member having one side edge portion as a pressing portion.

25. The liquid honing method as recited in claim 15, wherein the scrubbing member is a cylindrical shape member, wherein in a hollow portion of the scrubbing member, a washing liquid supplying pipe for supplying the washing liquid into an inside of the scrubbing member is inserted in an axial direction of the scrubbing member, and wherein the work is subjected to the scrub washing process while exuding the washing liquid in the washing liquid supplying pipe to the outside surface of the scrubbing member via the interconnected cells of the scrubbing member.

26. The liquid honing method as recited in claim 25, wherein the scrubbing member and the work are is disposed vertically, respectively, wherein one of the end portions of the washing liquid supplying pipe is closed, and wherein the other end portion of the washing liquid supplying pipe is connected to a washing liquid introducing pipe for introducing the washing liquid in the washing liquid supplying pipe.

27. The liquid honing method as recited in claim 15, wherein the porous soft material of the scrubbing member is made of any one of PVA series resin foam, polyethylene series resin foam, polyether series resin foam, vinyl acetate series resin foam and polyurethane series resin foam.

28. The liquid honing method as recited in claim 15, wherein the work is a raw pipe for precision pipes.

29. The liquid honing method as recited in claim 15, wherein the work is a raw pipe for photoconductor drum substrate pipes.

* * * * *